US012305949B2

(12) United States Patent
Geissele

(10) Patent No.: US 12,305,949 B2
(45) **Date of Patent: *May 20, 2025**

(54) FIREARM ASSEMBLIES WITH MULTIPLE GAS PORTS

(71) Applicant: WHG PROPERTIES, LLC, North Wales, PA (US)

(72) Inventor: William H. Geissele, North Wales, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/354,359

(22) Filed: Jul. 18, 2023

(65) Prior Publication Data

US 2023/0366643 A1 Nov. 16, 2023

Related U.S. Application Data

(63) Continuation of application No. 17/450,319, filed on Oct. 8, 2021, now Pat. No. 11,747,101, which is a continuation of application No. 17/069,327, filed on Oct. 13, 2020, now Pat. No. 11,365,945.

(51) Int. Cl.

| | |
|---|---|
| ***F41A 5/26*** | (2006.01) |
| ***F41A 5/20*** | (2006.01) |
| ***F41A 21/28*** | (2006.01) |

(52) U.S. Cl.

CPC ..... *F41A 5/20* (2013.01); *F41A 5/26* (2013.01); *F41A 21/28* (2013.01)

(58) Field of Classification Search

CPC ..... F41A 5/18; F41A 5/20; F41A 5/26; F41A 5/28

USPC ..... 89/191.01–193

See application file for complete search history.

(56) References Cited

U.S. PATENT DOCUMENTS

| | | | |
|---|---|---|---|
| 784,966 | A | 3/1905 | Smith |
| 785,974 | A | 3/1905 | McClean |
| 817,197 | A | 4/1906 | Smith |
| 933,098 | A | 9/1909 | McClean |
| 966,995 | A | 8/1910 | Brown |

(Continued)

FOREIGN PATENT DOCUMENTS

| | | | |
|---|---|---|---|
| GB | 191011507 | A | 12/1910 |
| GB | 2131134 | A | 6/1984 |
| WO | WO-2020/123878 | A1 | 6/2020 |

OTHER PUBLICATIONS

International Search Report and Written Opinion for PCT/US2021/054771 (ISA/EP) mailed Jul. 5, 2022 (13 pages).

(Continued)

*Primary Examiner* — Jonathan C Weber

(74) *Attorney, Agent, or Firm* — ALSTON & BIRD LLP

(57) ABSTRACT

An assembly for directing propellant gas to an action of a firearm includes a barrel and a gas block. The barrel has a plurality of gas ports that communicate with the bore of the barrel. The barrel and the gas block define a passage that receives pressurized propellant gas from the bore by way of the barrel gas ports, and directs the propellant gas to a gas port of the gas block. The plurality of barrel gas ports and the passage act as a manifold in which the propellant gas is taken from multiple locations within the barrel, combined into a single flow, and directed into the gas block via the gas block gas port. The pressurized gas is then routed to an action of the firearm by way of a gas tube and a gas key.

18 Claims, 26 Drawing Sheets

(56) References Cited

U.S. PATENT DOCUMENTS

| | | | |
|---|---|---|---|
| 1,003,632 | A | 9/1911 | McClean |
| 1,066,487 | A | 7/1913 | Giletta |
| 2,777,366 | A | 1/1957 | Cook |
| 3,988,964 | A | 11/1976 | Moore |
| 4,085,654 | A | 4/1978 | Panigoni |
| 4,088,057 | A | 5/1978 | Nasypany |
| 4,373,423 | A | 2/1983 | Moore |
| 4,414,880 | A | 11/1983 | Throner |
| 4,503,632 | A | 3/1985 | Cuevas |
| 6,868,770 | B2 | 3/2005 | Comils |
| 8,393,259 | B2 | 3/2013 | Larue |
| 8,443,712 | B2 | 5/2013 | Molinari |
| 8,640,598 | B1 | 2/2014 | Jackson |
| 9,500,422 | B2 | 11/2016 | Gomirato |
| 9,719,739 | B2 | 8/2017 | Wind |
| 2004/0237766 | A1 | 12/2004 | Comils |
| 2011/0271836 | A1 | 11/2011 | Molinari |
| 2012/0167756 | A1 | 7/2012 | Larue |
| 2016/0003566 | A1 | 1/2016 | Gomirato |
| 2016/0216055 | A1 | 7/2016 | Wilkinson |
| 2021/0207904 | A1 | 7/2021 | Kroyer |

OTHER PUBLICATIONS

U.S. Appl. No. 17/450,319, filed Oct. 8, 2021, U.S. Pat. No. 11,747,101.

U.S. Appl. No. 17/069,327, filed Oct. 13, 2020, U.S. Pat. No. 11,365,945.

FIG. 57
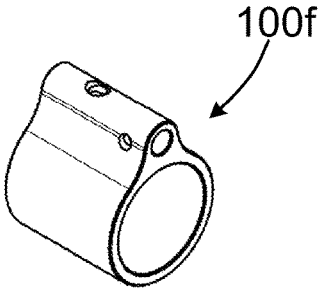
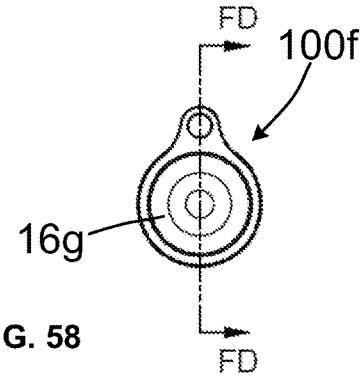
FIG. 58
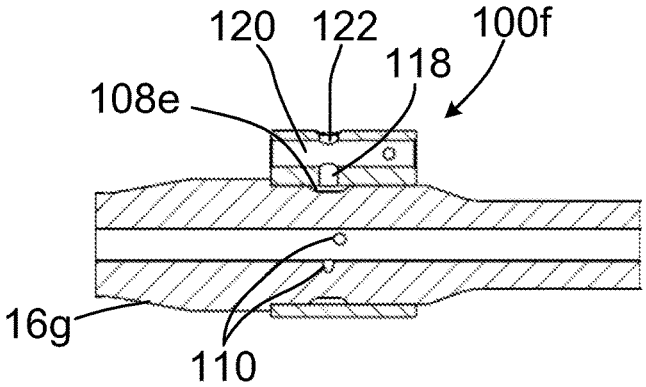
FIG. 59
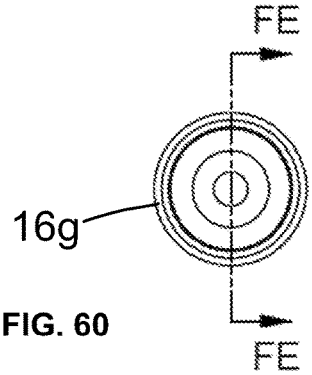
FIG. 60
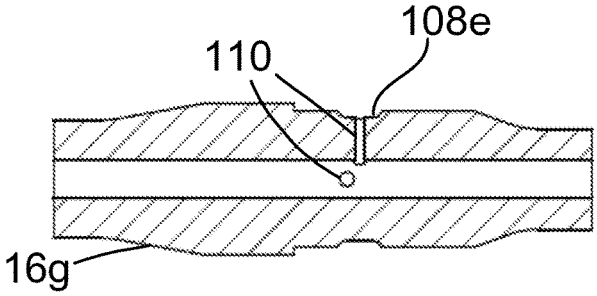
FIG. 61

FIREARM ASSEMBLIES WITH MULTIPLE GAS PORTS

CROSS-REFERENCE TO RELATED APPLICATIONS

This application is a is a Continuation of U.S. patent application Ser. No. 17/450,319, filed on Oct. 8, 2021, which is a Continuation-in-Part of and claims priority to U.S. patent application Ser. No. 17/069,327, filed on Oct. 13, 2020, the contents of each of which are hereby incorporated by reference in their entirety.

FIELD

The inventive concepts disclosed herein relate to assemblies for gas-actuated firearms in which propellant gas generated by the discharge of the firearm is used to actuate an internal mechanism that automatically reloads the firearm, and firearms that include such assemblies.

BACKGROUND

Tactical rifles and other types of firearms commonly are equipped with a gas system configured to capture energy, in the form of high-pressure gas, generated by the discharge of the firearm. The energy is used to activate and cycle a mechanism, or action, that automatically reloads the firearm. Gas-actuated firearms may include a single gas port in the barrel to cause pressurized gas to operate portions of the action of the firearm.

When a cartridge (also referred to as a round of ammunition) is discharged within a firearm, a projectile of the cartridge is propelled through the bore by high-pressure gas generated by the ignition of propellant within the cartridge case. When the propellant gas reaches the barrel gas port, a portion of the propellant gas enters that port. The pressurized propellant gas then energizes the action of the firearm to eject from the firearm the now-empty case of the fired cartridge; cock the firing mechanism of the firearm; strip an unfired cartridge from a magazine of the firearm; and load the unfired cartridge into a chamber of the barrel.

In general, the surface of the barrel that defines the barrel gas port is susceptible to erosion as the hot, high-pressure propellant gas, which includes abrasive combustion byproducts, passes through the barrel gas port at high velocity. Over time, the erosion can enlarge and alter the shape of the barrel gas port, which can increase the pressure of the propellant gas within the gas system, potentially resulting in premature wear and failure of the action and other components of the firearm.

Also, a projectile traveling down the barrel immediately after discharge can expand against the adjacent interior surface of the barrel as a result of the pressure of the expanding gas behind it. When the projectile passes the barrel gas port, this expansion will push some of the projectile into the gas port, which in turn will shave off material from the projectile. The resulting imbalance in the projectile can reduce the gyroscopic stability of the projectile, causing the projectile to deviate from its intended flight path, thereby reducing shooting accuracy. Thus, a need exists for an improved firearm gas system.

SUMMARY

The present disclosure generally relates to multi-port gas block assemblies for firearms. In one aspect, the disclosed technology relates to an assembly for directing propellant gas to an action of a firearm, including: a barrel defining a bore configured to guide a projectile as the projectile is propelled through the bore by pressurized gas, the barrel having a plurality of barrel gas ports formed therein, each of the barrel gas ports being in fluid communication with the bore; and at least one gas block configured to align with an axial location of the barrel gas ports, the at least one gas block having a gas block gas port formed therein, wherein at least one of the barrel and the at least one gas block define a passage configured to direct the pressurized gas from the barrel gas ports to the gas block gas port. In one embodiment, the passage is in fluid communication with the barrel gas ports and the gas block gas port. In another embodiment, at least one of an outer surface of the barrel and an inner surface of the at least one gas block has a groove formed therein; the groove is in fluid communication with the barrel gas ports; and the groove at least partly defines the passage. In another embodiment, the groove extends along an entire circumference of the outer surface of the barrel or an entire circumference of the inner surface of the at least one gas block. In some embodiments, the barrel and the at least one gas block are rotationally agnostic relative to each other, such that the barrel and the at least one gas block are configured direct the pressurized gas from the plurality of barrel gas ports to the gas block gas port in at least two relative rotational positions between the barrel and the at least one gas block. In some embodiments, the groove extends along an entire circumference of the outer surface of the barrel, an exit of one of the plurality of gas ports is disposed in the groove at a first location along a length of the barrel, and an exit of a second one of the plurality of barrel gas ports is positioned in the groove at a second location along the length of the barrel different than the first location. In another embodiment, the groove extends along not more than a portion of a circumference of the outer surface of the barrel or a portion of a circumference of the inner surface of the at least one gas block. In another embodiment, the barrel has an inner surface that defines the bore; each of the barrel gas ports has an entrance defined by the inner surface of the barrel; and the entrances of the barrel gas ports are spaced apart along a circumference of the inner surface barrel by substantially equal angular distances. In some embodiments, two or more of the gas ports may be arranged linearly at a same angular position and different axial positions along the length of the barrel.

In another embodiment, the barrel has an inner surface that defines the bore; each of the barrel gas ports has an entrance defined by the inner surface of the barrel; the entrance of one of the barrel gas ports is positioned at a first location along a length of the barrel; and the entrance of a second one of the barrel gas ports is positioned at a second location along the length of the barrel. In another embodiment, the groove extends in a curvilinear path along the outer surface of the barrel or along the inner surface of the at least one gas block. In another embodiment, the groove extends in a linear path along the outer surface of the barrel or along the inner surface of the at least one gas block. In another embodiment, the barrel has three barrel gas ports formed therein. In another embodiment, the at least one gas block has a gas tube receiving passage formed therein and configured to receive an end of a gas tube, wherein the gas tube receiving passage is in fluid communication with the at least one gas block gas port. In another embodiment, the groove is formed in the outer surface of the barrel; and the passage is defined by the groove and an adjacent portion of the inner surface of the at least one gas block. In another embodiment, an exit of each of the barrel gas ports is located at least partly within the groove. In another embodiment, the groove is formed in the inner surface of the at least one gas block; and the passage is defined by the groove and an adjacent portion of the outer surface of the barrel.

In some embodiments, the gas block may be configured to be mounted on the barrel. In some embodiments, the gas block and the barrel may define a single integral piece.

In another embodiment, the barrel gas ports extend radially in relation to a longitudinal axis of the barrel. In another embodiment, the groove has a semi-circular cross section. In another embodiment, the passage and the barrel gas ports form a manifold operable to supply a stream of the pressurized gas to the gas block gas port from the barrel gas ports.

In another aspect, the disclosed technology relates to an assembly for directing propellant gas to an action of a firearm, including: a barrel defining a bore configured to guide a projectile as the projectile is propelled through the bore by pressurized gas, the barrel having a plurality of barrel gas ports formed therein, each of the barrel gas ports being in fluid communication with the bore; and at least one gas block configured align with an axial location of the plurality of barrel gas ports, wherein: the at least one gas block has a gas port formed therein; the at least one gas block includes a conduit having an entrance and an exit; and the conduit is configured so that the entrance to the conduit aligns with, and is in fluid communication with one of the barrel gas ports, and the exit aligns with, and is in fluid communication with the gas block gas port. In one embodiment, the at least one gas block is configured so that the gas block gas port aligns with and is in fluid communication with another one of the barrel gas ports. In another aspect, the disclosed technology relates to a firearm, including any of the assemblies disclosed herein. According to some embodiments, the gas block gas port aligns with the plurality of barrel gas ports, and where the plurality of barrel gas ports are displaced relative to one another along an axis along which the barrel extends.

In some embodiments, a barrel for a firearm is provided, including: an inner surface defining a bore configured to guide a projectile as the projectile is propelled through the bore by pressurized gas, wherein the barrel has a plurality of barrel gas ports formed therein, wherein each of the barrel gas ports has an entrance defined by the inner surface of the barrel, and wherein each of the barrel gas ports is configured to simultaneously fluidically connect to a passage for directing the pressurized gas to an action of the firearm. In some embodiments, an outer surface of the barrel has a groove formed therein, wherein the groove is in fluid communication with the barrel gas ports, and wherein the groove at least partly defines the passage. According to some embodiments, the plurality of barrel gas ports are displaced relative to one another along an axis along which the barrel extends. According to some embodiments, the plurality of barrel gas ports are disposed along a line extending along the axis along which the barrel extends. In some embodiments, at least two of the plurality of barrel gas ports may be defined at different axial locations along a length of the barrel. In some embodiments, each of the plurality of barrel gas ports may be defined at a same axial location along a length of the barrel. The plurality of barrel gas ports may be spaced circumferentially about the barrel. As used herein, terms such as "axial location" refer to a position relative to the stated parameter without regard to other parameters (e.g., a position measured with respect to the axis of the length of the barrel without regard to the corresponding radial position unless stated otherwise).

In another embodiment, an assembly for directing gas to an action of a firearm may be provided, including: a barrel having an interior surface, the interior surface defining a plurality of entrance openings configured to receive pressurized gas therethrough; and means for directing the pressurized gas from each of the plurality of entrance openings to the action of the firearm. In some embodiments, at least two of the plurality of barrel gas ports may be defined at different axial locations along a length of the barrel. According to some embodiments, the plurality of entrance openings configured to receive pressurized gas therethrough are displaced relative to one another along an axis along which the barrel extends. The plurality of entrance openings configured to received pressurized gas therethrough are, in some embodiments, disposed along a line parallel to the axis along which the barrel extends. In some embodiments, each of the plurality of entrance openings is defined at a same axial location along a length of the barrel. In some embodiments, the plurality of entrance openings are spaced circumferentially about the barrel. In some embodiments, the means for directing the pressurized gas from each of the plurality of entrance openings to the action of the firearm may include a means for combining portions of the pressurized gas associated with each of the plurality of entrance openings into a single flow upstream of the action.

Embodiments provided herein include an assembly for directing gas to an action of a firearm, the assembly including: a barrel defining a bore configured to guide a projectile as the projectile is propelled through the bore by pressurized gas, the barrel having a plurality of barrel gas ports formed therein, each of the plurality of barrel gas ports being in fluid communication with the bore; and at least one gas block configured to align with an axial location of the plurality of barrel gas ports, the at least one gas block having a gas block gas port formed therein, where at least one of the barrel and the at least one gas block define a passage configured to direct the pressurized gas from the plurality of barrel gas ports to the gas block gas port. The passage of some embodiments is in fluid communication with the plurality of barrel gas ports and the gas block gas port.

According to some embodiments, at least one of an outer surface of the barrel and an inner surface of the at least one gas block has a groove formed therein, the groove is in fluid communication with the plurality of gas ports, and the groove at least partly defines the passage. The plurality of barrel gas ports of some embodiments are spaced apart along a line parallel to an axis along which the barrel extends. The groove of some embodiments covers the plurality of gas ports. The groove of some embodiments is formed in the outer surface of the barrel, and the passage is defined by the groove and an adjacent portion of the inner surface of the at least one gas block. The plurality of barrel gas ports in some embodiments are spaced apart along a line parallel to an axis along which the barrel extends.

According to some embodiments, the plurality of barrel gas ports are parallel to one another, and axes of each of the barrel gas ports are offset relative to one another. A groove is defined in the bore of some embodiments, where each of the plurality of barrel gas ports extend from the groove of the bore of the barrel. The plurality of gas ports of some embodiments extend from a common opening at a surface of the barrel to individual openings within the bore of the barrel. The individual openings of some embodiments are displaced from one another linearly along an axis defined by the bore.

According to some embodiments, the barrel has an inner surface that defines the bore, where each of the plurality of gas ports has an entrance defined by the inner surface of the barrel, where the entrance of one of the plurality of barrel gas ports is positioned at a first location along a length of the barrel, and where the entrance of a second one of the plurality of barrel gas ports is positioned at a second location along the length of the barrel, different from the first location. The at least one gas block of some embodiments has a gas tube receiving passage formed therein and configured to receive an end of a gas tube, where the gas tube receiving passage is in fluid communication with the gas block port. The passage and the plurality of barrel gas ports of some embodiments form a manifold operable to supply a stream of the pressurized gas to the gas block gas port from the plurality of barrel gas ports. The at least one gas block of some embodiments is configured to be mounted on the barrel. The at least one gas block of some embodiments and the barrel define a single, integral piece. Embodiments optionally include a firearm including the embodiments of the assembly described above.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and do not limit the scope of the present disclosure. The drawings are not to scale and are intended for use in conjunction with the explanations provided herein. Embodiments of the present disclosure will hereinafter be described in conjunction with the appended drawings.

FIG. 57 is a perspective view of the gas block of FIG. 52.

FIG. 58 is a front view of the barrel and gas block of FIG. 52.

FIG. 59 is a cross-sectional view taken through the line "FD-FD" of FIG. 58.

FIG. 60 is a front view of the barrel of FIG. 52.

FIG. 61 is a cross-sectional view taken through the line "FE-FE" of FIG. 60.

DETAILED DESCRIPTION

Figure 1:
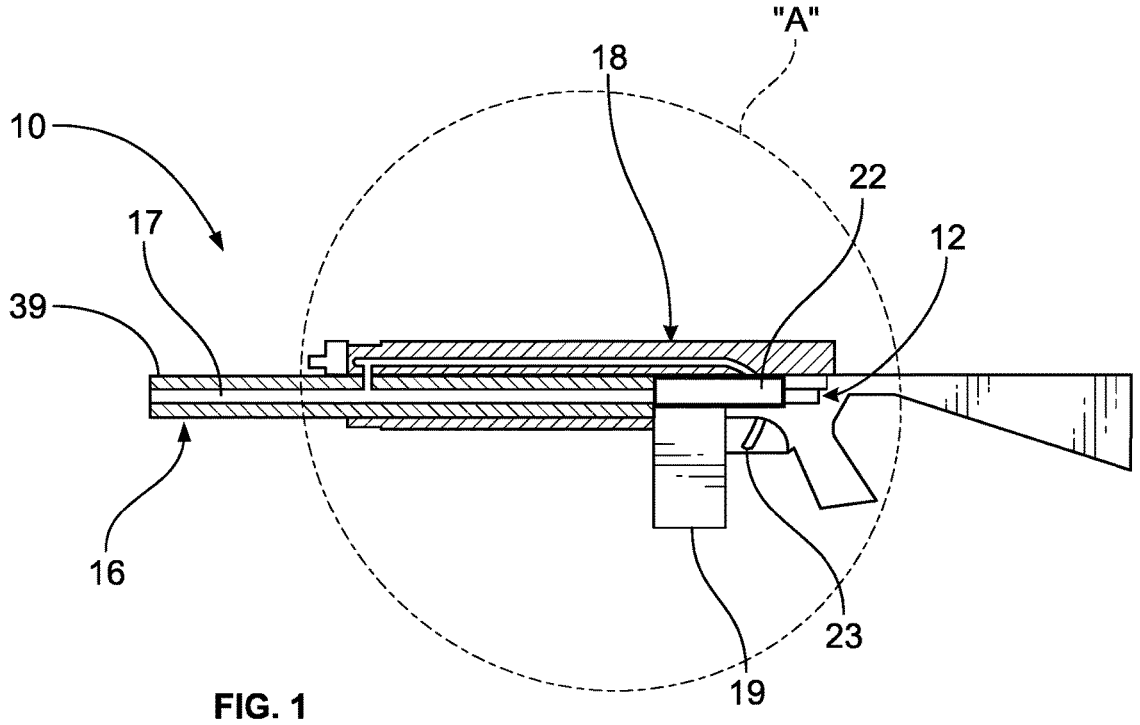
FIG. 1 is a cross-sectional, schematic side view of an exemplary firearm equipped with a barrel and gas block assembly as described herein.

The inventive concepts are described with reference to the attached figures, wherein like reference numerals represent like parts and assemblies throughout the several views. The figures are not drawn to scale and are provided merely to illustrate the instant inventive concepts. The figures do not limit the scope of the present disclosure or the appended claims. Several aspects of the inventive concepts are described below with reference to example applications for illustration. It should be understood that numerous specific details, relationships, and methods are set forth to provide a full understanding of the inventive concepts. One having ordinary skill in the relevant art, however, will readily recognize that the inventive concepts can be practiced without one or more of the specific details or with other methods. In other instances, well-known structures or operation are not shown in detail to avoid obscuring the inventive concepts.

Embodiments of the present disclosure may include a firearm having a barrel with multiple flow paths defined in the bore of the barrel through which pressurized gas may flow. These multiple flow paths may be combined and directed to the action to energize various functions of the firearm action, such as ejecting a spent casing, loading a new cartridge, and cocking a trigger mechanism. In various embodiments the flow paths may include a plurality of barrel gas ports defined in the barrel, which are fluidically combined into a single passage or conduit at or before the action. The barrel gas ports may be simultaneously fluidically coupled with at least a portion of the action to allow pressurized gas to travel to the action via any of the barrel gas ports. In some embodiments, each of the barrel gas ports may be continuously fluidically connected with the action between a point at or upstream of an inner surface of the barrel to the action.

Figure 2:
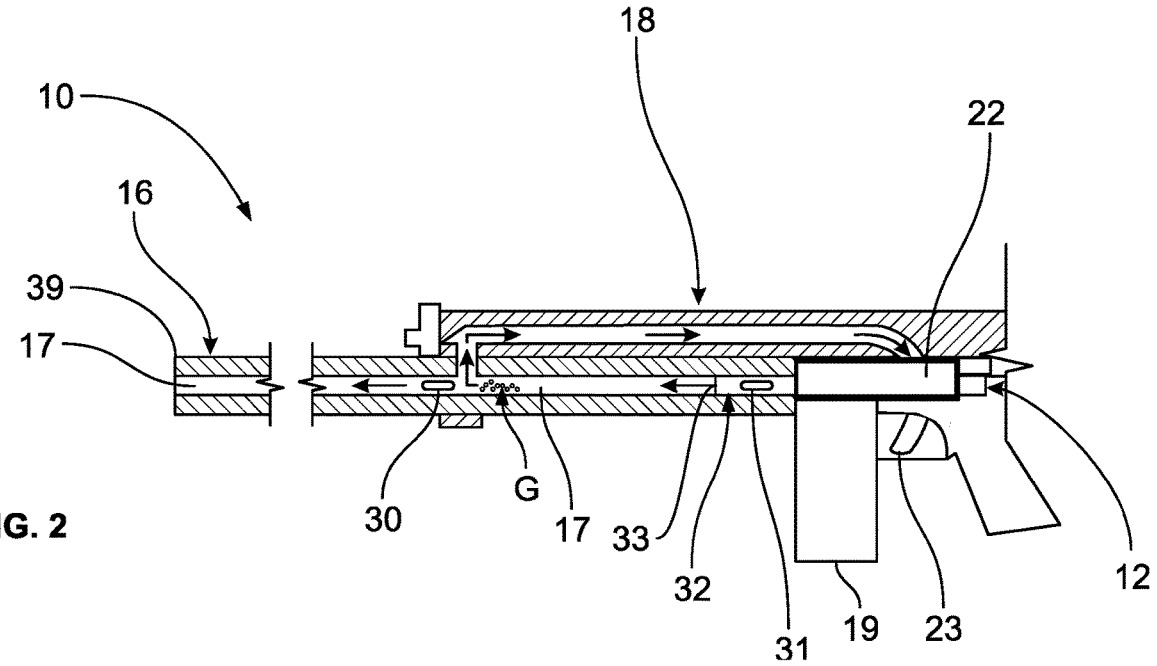
FIG. 2 is a magnified view of the area designated "A" in FIG. 1.

FIGS. 1 and 2 schematically depict a gas-operated firearm 10 according to various embodiments discussed herein. The firearm 10 may be a semi-automatic firearm (e.g., a rifle) that fires a projectile 30 (e.g., bullet). The firearm 10 is equipped with a gas system 18 configured to capture energy generated by the firing of the projectile 30, and to use the captured energy to cycle a mechanism that automatically reloads and cock the hammer of the firearm 10. Specific details of the firearm 10 are presented for exemplary purposes only. The inventive principles disclosed herein can be applied to other types of firearms, including but not limited to other types of rifles, including automatic rifles, shotguns, and pistols.

In the depicted embodiment, the firearm 10 includes a receiver 12, a barrel 16, and a magazine 19 that holds unfired rounds of ammunition or cartridges 32. Each cartridge 32 may include a case 31 with a projectile 30, a primer (not shown), and a propellant (also not shown) all housed within the case 31. The barrel 16 may include a chamber 33 that receives and houses an individual cartridge 32 immediately prior to firing, as shown in FIG. 2. The barrel 16 need not be a single integral piece. Prior to firing, the cartridge 32 may be held in the chamber 33 by a bolt (e.g., bolt member 132 shown in FIG. 3) of the receiver 12.

The depicted receiver 12 includes a trigger mechanism and an action 22. The trigger mechanism includes a trigger 23 that is pulled by the user, or shooter, in order to initiate the firing sequence of the firearm 10. Prior to firing, the trigger mechanism may hold a spring-loaded hammer (not shown) in a cocked position. The trigger mechanism may prevent the hammer from moving until the trigger 23 is pulled, and may release the hammer when the trigger 23 is pulled. Upon release, the hammer may strikes a firing end of the cartridge 32, via a firing pin assembly, causing the primer within the cartridge 32 to ignite the propellant. Once ignited, the propellant forms a high-pressure propellant gas G that propels the projectile 30 through a lengthwise bore 17 formed in the barrel 16, until the projectile 30 exits the end, or muzzle 39 of the barrel 16 at high velocity. The projectile 30 may at least partially seal the bore 17 to cause the buildup of propellant gas G pressure behind the projectile for both driving the projectile and, once the projectile passes a gas port in the barrel 16 associated with the gas system 18, for driving the action 22.

The action 22 ejects the spent case 31 from the firearm 10 after firing, reloads an unfired, or pre-firing, cartridge 32 into the chamber 33 from the magazine 19, and cocks the hammer of the trigger mechanism. The action 22 is gas-actuated, i.e., the action 22 may receive energy from the gas system 18 in the form of at least a portion of the high-pressure propellant gas G generated by the burning propellant of the cartridges 32, and the energy may cause the action 22 to eject the spent case 31, to reload an unfired cartridge 32, and cock the trigger mechanism.

The depicted gas system 18 is a direct-impingement gas system in which the propellant gas G acts directly on the action 22. However, the technology disclosed herein can be used in connection with other types of gas systems, such as gas piston systems, including any gas system that directly or indirectly transfers energy of the propellant gas G from the bore 17 to drive the action 22. In such embodiments, the action may be said to include such pistons or other energy transfer mechanisms. Additionally, the depicted action 22 is a bolt carrier group, but other types of actions can be used in the alternative. The operation of such actions and other receiver components and trigger mechanisms in response to the inventive gas systems, methods, and assemblies disclosed herein would be understood by one of ordinary skill in the art in light of the present disclosure.

Figure 3:
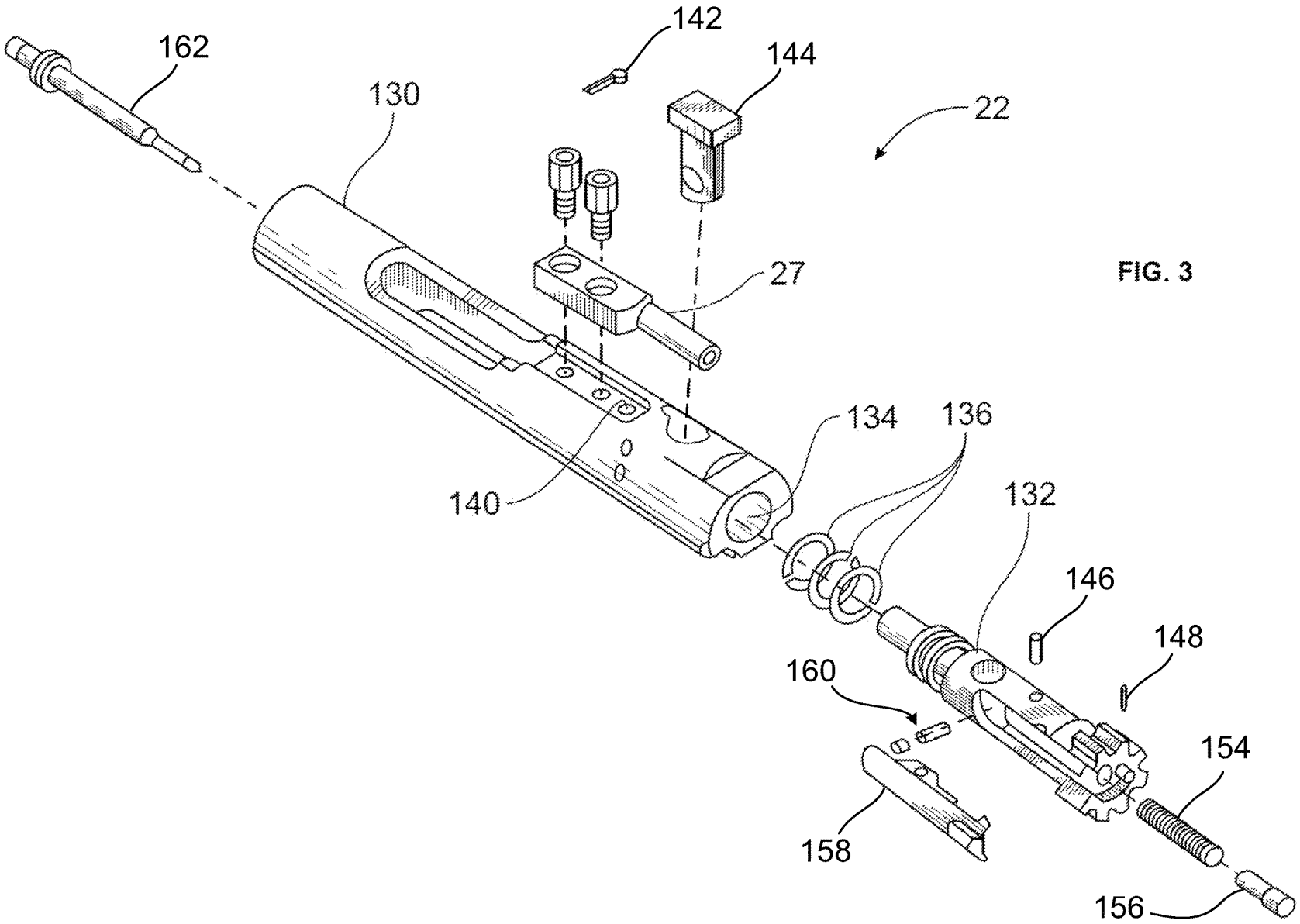
FIG. 3 is a partially exploded view of an action of the firearm shown in FIGS. 1 and 2.

As shown in FIG. 3, an example embodiment of the action 22 includes a bolt carrier 130 and a bolt member 132. The bolt carrier 130 defines a bolt chamber 134. A rearward portion of the bolt member 132 is positioned within the bolt chamber 134, and can move both linearly and rotationally within the bolt chamber 134. The bolt member 132 may include gas seal rings 136 that form a movable seal between the bolt member 132 and the adjacent surface of the bolt carrier 130 within the bolt chamber 134. A volume between an internal wall of the bolt carrier 130 and the rear portion of the bolt member 132 forms a gas actuation chamber that receives the propellant gas G.

With continued reference to FIG. 3, in the depicted embodiment, the bolt carrier 130 receives the propellant gas G from the barrel 16 and gas system 18 (examples of which are shown in FIGS. 1-2). In particular, the gas system 18 may direct the propellant gas G into a gas key 27 attached to the bolt carrier 130, and the gas key 27 may direct the gas into a gas inlet port 140 on the bolt carrier 130. The gas inlet port may fluidically connect to the gas actuation chamber defined between the inner wall of the bolt carrier 130 and the rear portion of the bolt member 132, such that, unless otherwise obstructed by the moving elements described herein, the bore 17 of the barrel 16 is configured to be fluidically connected to the gas actuation chamber within the bolt carrier 130 via the gas system 18 (e.g., via gas tube receiving passage 120 shown in FIG. 9). As would be appreciated by one skilled in the art in light of the present disclosure, the action 22 may include a firing pin 162, a firing pin retainer pin 142, and/or a bolt cam pin 144. The bolt member 132 may include an extractor 158, extractor spring assembly 160 and/or, an extractor pin 146. The bolt member 132 may include an ejector 156, ejector spring 154, and/or an ejector roll pin 148.

During firing of the depicted embodiment, when the trigger 23 is pulled and before any movement of the bolt carrier 130, a head portion of the bolt member 132 may be locked with the barrel 16 to prevent the bolt member 132 from being forced rearward by the initial inertia of the projectile case during combustion of the propellant. In some embodiments, once the propellant gas G passes through the gas system 18 and enters the bolt carrier 130, the pressure of the propellant gas G acts on (1) the surface of the bolt member 132 and on the gas seal rings 136 of the bolt member 132 on the one hand and (2) on the rear, interior surfaces of the bolt carrier 130 on the other hand. Because the bolt member 132 cannot move forward, due to being in contact with the barrel 16, the resulting pressure of the propellant gas G in the gas actuation chamber causes the bolt carrier 130 to move rearward, in a linear direction, within the receiver 12.

In one embodiment, as the bolt carrier 130 is initially retracted rearward under the pressure of the propellant gas G, the bolt member 132 is rotated sufficiently (e.g., via camming surfaces (not shown) between the bolt carrier 130 and bolt member 132) to unlock its head portion from a locking receptacle (not shown) of the barrel 16. The bolt member 132 then retracts along with the bolt carrier 130 as the inertia of the bolt carrier 130 continues rearward. As the bolt member 132 is retracted, it extracts a spent cartridge case 31 from the chamber 33 of the barrel 16, and ejects the spent case 31 through a cartridge port, or breech (not shown), formed in the receiver 12. The rearward movement of the bolt carrier 130 may also cause cocking of the trigger mechanism.

In some embodiments, the bolt carrier 130 compresses a recoil spring (not shown) as the bolt carrier 130 and bolt member 132 translate rearward. The recoil spring may drive the bolt carrier 130 and the bolt member 132 forward when the pressure exerted by the propellant gas G has decreased sufficiently so as to be overcome by the force of the recoil spring. As the bolt carrier 130 and bolt member 132 subsequently are driven forward by the force of the recoil spring, the head portion of the bolt member strips an unfired cartridge 32 from the magazine 19, and feeds the cartridge 32 into the chamber 33 of the barrel 16 in preparation for subsequent firing. The bolt member 132 may again be axially rotated (e.g., by camming surfaces between the bolt carrier 130 and bolt member 132) to lock the head portion of the bolt member 132 with the barrel 16 when the cartridge is 32 inserted in the chamber 33. In some embodiments, the gas system 18 includes a gas block 100 configured for mounting on the barrel 16. In some embodiments, the gas block 100 and barrel 16 may be one integral piece made of a single block of material, separately formed components that are then attached (e.g., welded, screwed, adhered, or the like) during assembly, or any other manner of producing the described structures as a whole. In some embodiments, multiple gas blocks may be used, with one or more ports being defined in two different blocks, with the multiple gas blocks operating as described herein with respect to any embodiment of a gas block. Unless stated otherwise, reference to a "gas block" and a "barrel" does not imply or require the two named elements to comprise a single integral piece or multiple pieces. Unless stated otherwise, two or more components that are not required to move relative to one another during firing may be manufactured as a single piece or multiple pieces without departing from the spirit of the present disclosure, and two or more components that are not required to move relative to one another during firing but for which the use of either a single piece or multiple pieces is otherwise preferred (e.g., for manufacturability, maintainability, or other reasons) may be considered equivalent to the non-preferred single piece or multiple piece embodiments. The barrel 16 and the gas block 100 together form an assembly for directing propellant gas to the action 22 of the firearm 10 with or without one or more intermediate conduits.

Figure 4:
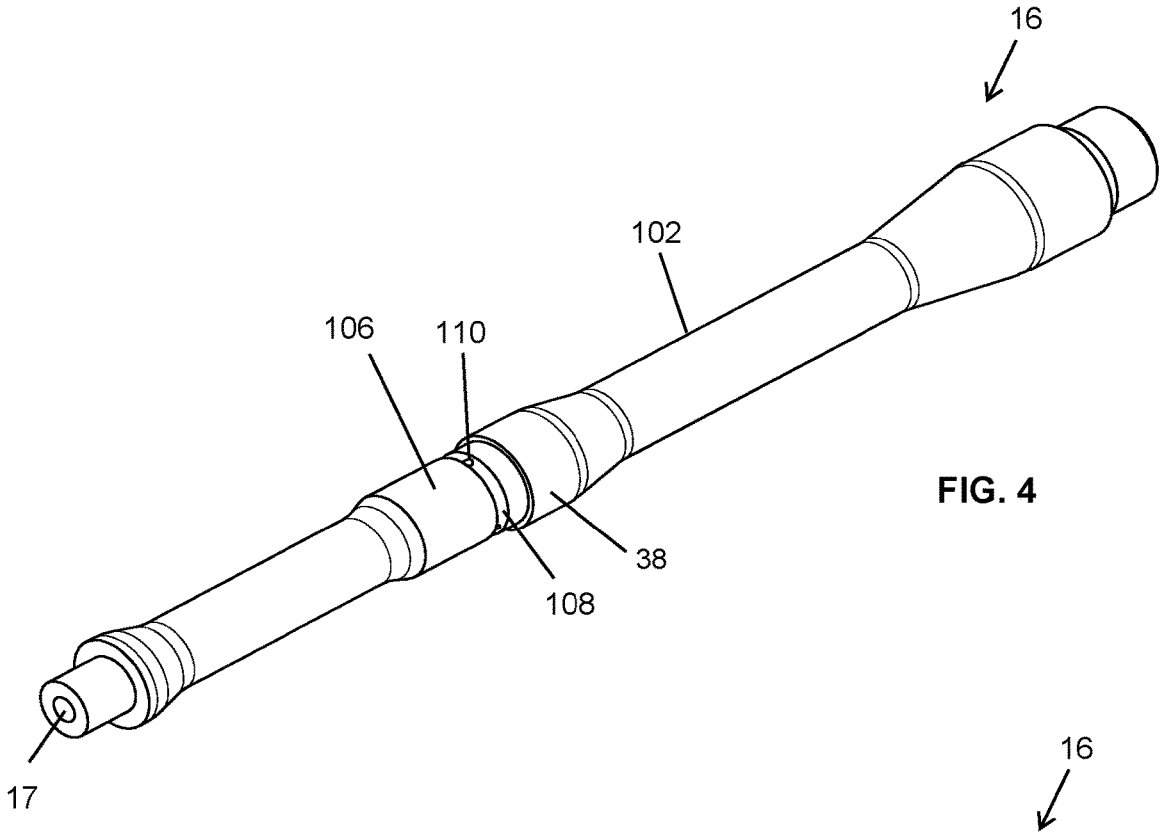
FIG. 4 is a front perspective view of a barrel of the firearm shown in FIGS. 1-3.
Figure 5:
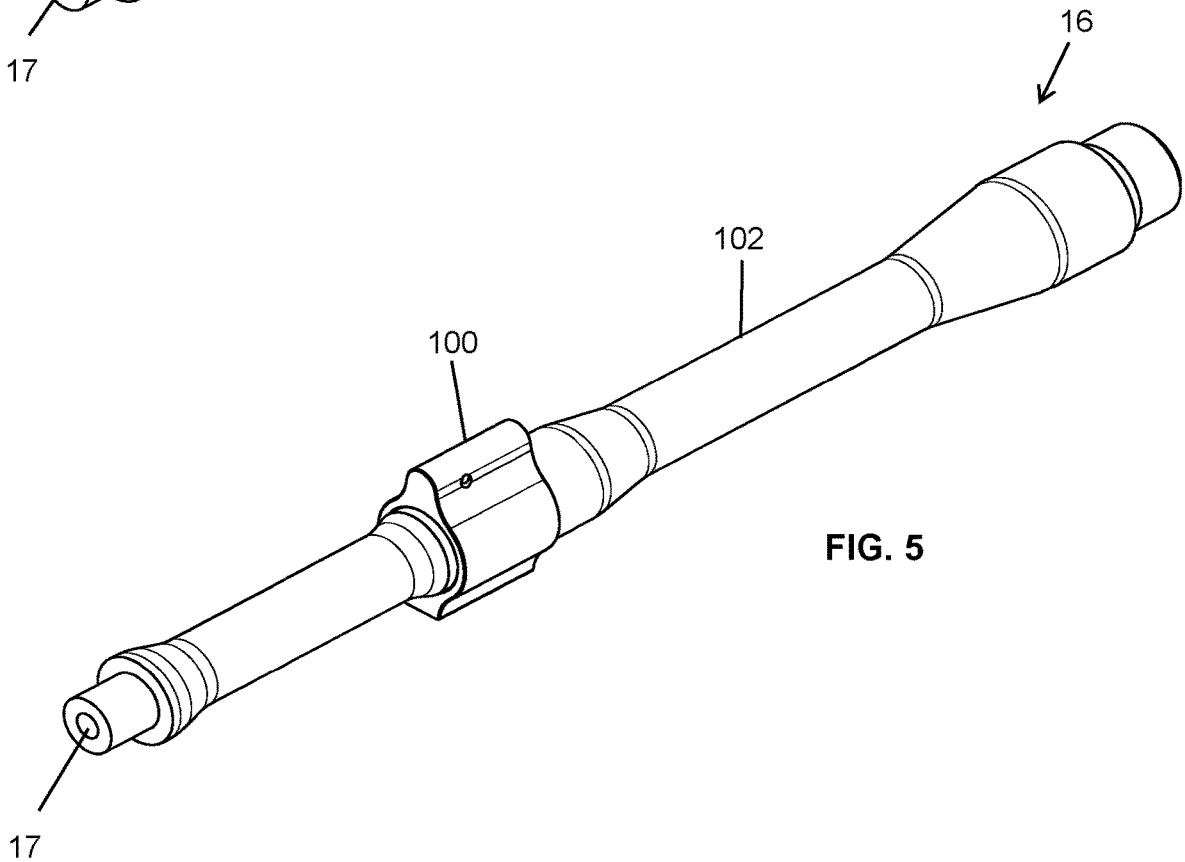
FIG. 5 is a front perspective view of the barrel shown in FIG. 4, with a gas block mounted thereon.
Figure 6:
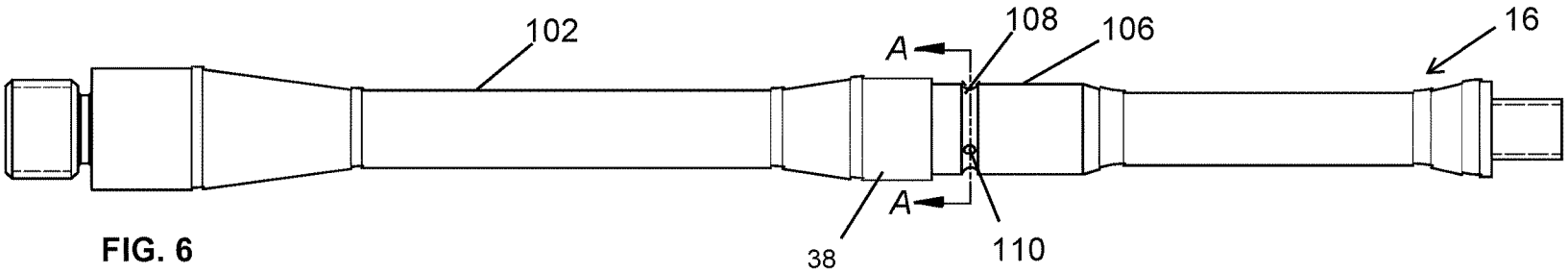
FIG. 6 is a side view of the barrel shown in FIGS. 4 and 5.
Figure 7:
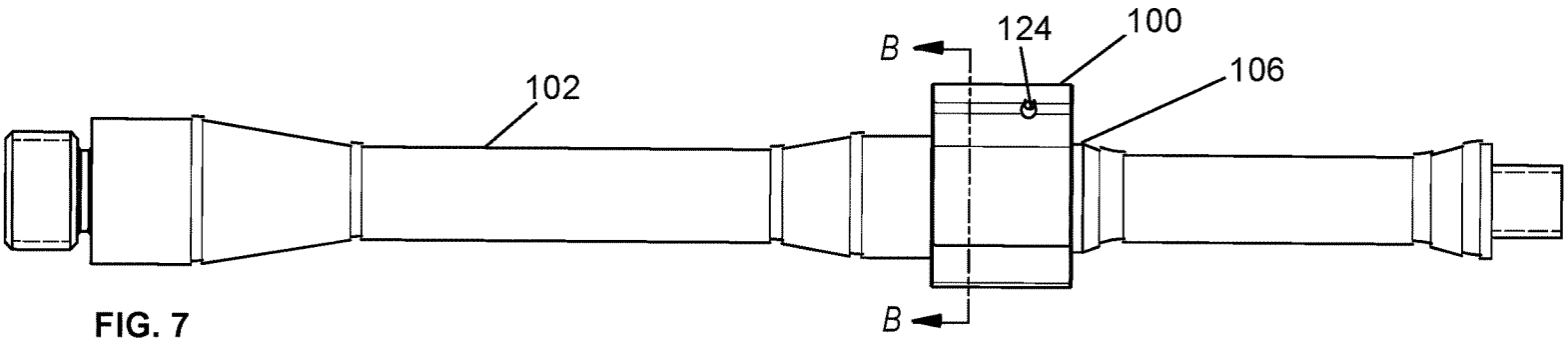
FIG. 7 is a side view of the barrel and gas block shown in FIGS. 4-6.
Figure 11:
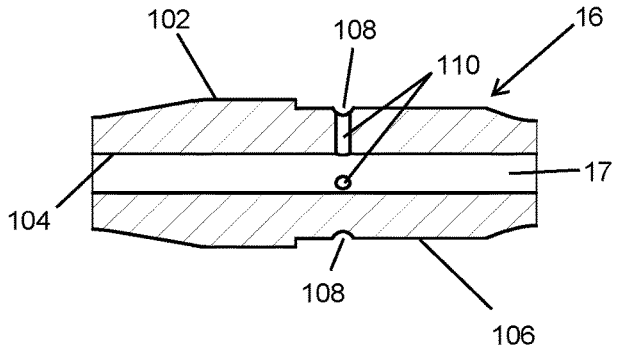
FIG. 11 is a cross-sectional view taken through the line "C-C" of FIG. 10.
Figure 12:
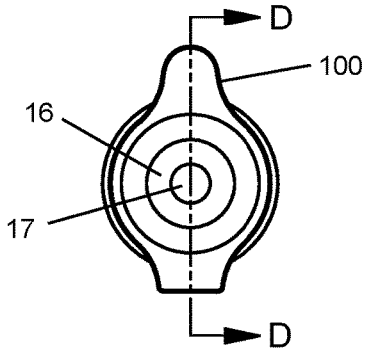
FIG. 12 is a front view of the barrel and gas block shown in FIGS. 4-11.
Figure 13:
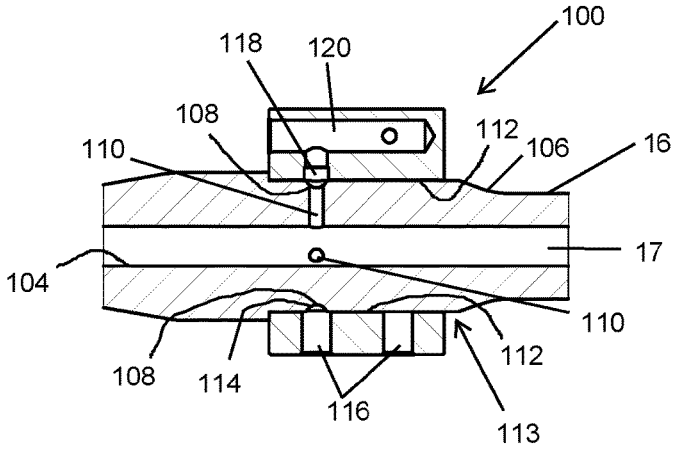
FIG. 13 is a cross-sectional view taken through the line "D-D" of FIG. 12.
Figure 14:
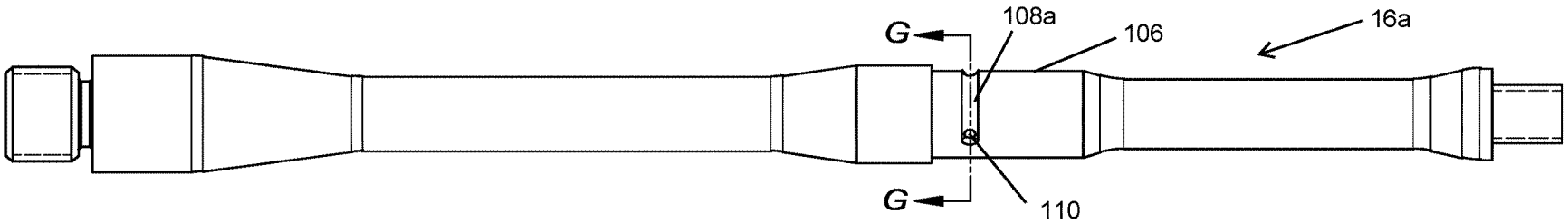
FIG. 14 is a side view of an alternative embodiment of the barrel shown in FIGS. 4-13.
Figure 15:
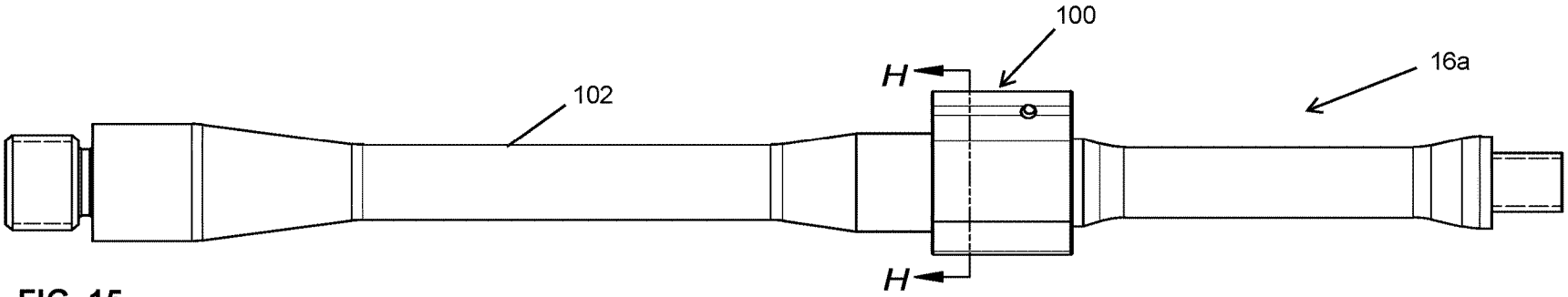
FIG. 15 is a side view of the barrel shown in FIG. 14, with the gas block shown in FIGS. 5, 7, 9, and 12 mounted thereon.

The barrel 16 has an outer surface 102; and an inner surface 104 that defines the bore 17. The inner surface 104 can have rifling to impart spin to the projectile 30 as it travels through the barrel 16 during discharge of the firearm 10. In one embodiment in which the gas block 100 is attached to the barrel 16, the outer surface 102 has a smooth and/or constant-diameter surface portion 106, as shown in FIGS. 4, 6, and 11, for engaging with the gas block 100. In some embodiments, a continuous indentation or groove 108 is formed in the surface portion 106, and extends along the entire outer circumference of the surface portion 106. The groove 108 can have a semi-circular cross section, as can be seen in FIGS. 6, 11, and 13; the cross-section of the groove 108 can have other shapes, such as square or rectangular, in alternative embodiments. In embodiments having a single-piece gas block and barrel, the groove may be equivalently described as a passage within the combined gas block and barrel.

In some embodiments, the barrel 16 may include a plurality of gas ports 110 terminating at the bore 107 of the barrel 16, such that the propellant gas G may have multiple flow paths out of the bore 17. With reference to FIGS. 4-29, 36-38, and 42-48, the depicted barrels 16 (including barrels 16*a*-16*f*) have three gas ports 110 formed therein. The barrel gas ports 110 are shown as having a cylindrical shape in FIGS. 8, 9, 11, and 13. In some embodiments, each barrel gas port 110 extends through the wall of the barrel 16, between the inner surface 104 and the groove 108. In some embodiments, one or more barrel gas ports 110 may fluidically connect within the barrel 16, such that the barrel includes multiple entrance openings at the surface of the bore 17 and one or more fewer outlet openings downstream of the bore. In some embodiments, each barrel gas port 110 forms a flow path that extends in a direction substantially perpendicular to the lengthwise (longitudinal) direction of the bore 17; and these flow paths place the bore 17 in fluid communication with the groove 108 so that the high-pressure propellant gas G within the bore 17 can reach the groove 108.

Figure 9:
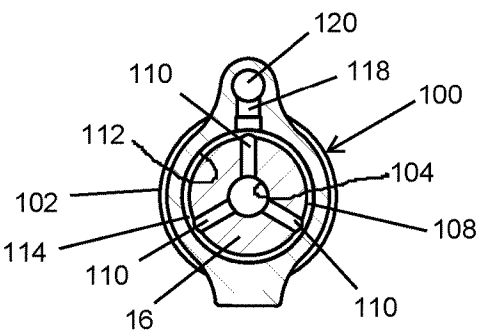
FIG. 9 is a cross-sectional view taken through the line "B-B" of FIG. 7.
Figure 8:
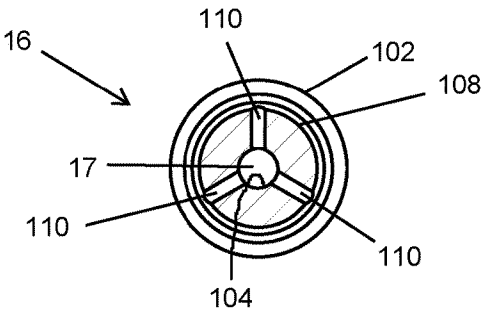
FIG. 8 is a cross-sectional view taken through the line "A-A" of FIG. 6.
Figure 10:
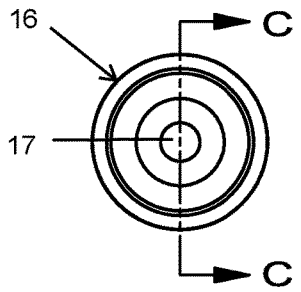
FIG. 10 is a front view of the barrel shown in FIGS. 4-9.

Referring to FIGS. 8 and 9, the depicted embodiment shows each barrel gas port 110 angularly spaced from the adjacent barrel gas ports 110 by about 120 degrees. More specifically, each of the barrel gas ports 110 of the depicted barrel 16 has an entrance defined by the inner surface 104 of the bore 107 of the barrel 16; and the entrances of adjacent ones of the barrel gas ports 110 are spaced apart along a circumference of the inner surface 104 by substantially equal (i.e., equal or approximately equal) angular distances. In some embodiments, the barrel gas ports 110 may each be disposed at the same axial position relative to a length of the barrel 16.

The barrel 16 can include a plurality of barrel gas ports 110—i.e., more or less than three gas ports 110, such as 2, 3, 4, 5, 6, 7 or more barrel gas ports 110. Additionally, adjacent barrel gas ports 110 can be angularly spaced, evenly or unevenly from each other by more or less than 120 degrees, such as 45, 60, 75, 90, 105, 135, 150, 165, or 180 degrees.

Each barrel gas port 110 has a diameter of, for example, about 0.068 inches in an example embodiment using three ports. In an example embodiment using one port, the port may have a diameter of, for example, about 0.089 inches. In some embodiments, the number of ports may be inversely proportional to the size of each port. In some embodiments, the diameter of each port may be determined as the minimum diameter required to actuate the firearm without malfunctioning. In some embodiments using multiple ports, each port may have a different diameter. As used herein, the term "about" in reference to a numerical value means plus or minus 15 percent of the numerical value of the number with which it is being used. Also, specific dimensions are presented herein for exemplary purposes only, and unless expressly stated otherwise are not intended to limit the scope of the appended claims; alternative embodiments can have dimensions other than those specified herein.

In some embodiments in which the gas block 100 attached to the barrel 16, the gas block 100 has an inner surface 112 that defines a cylindrical barrel receiving passage 113 within the gas block 100. The inner surface 112 is depicted in FIGS. 9, 13, and 30-32. As shown in FIG. 13, the barrel receiving passage 113 has a diameter that approximately matches the outer diameter of the barrel 16 at the location of the barrel gas ports 110 (e.g., the outer surface portion 106 described herein), so that the gas block 100 fits snugly over the barrel 16 with minimal clearance.

The groove 108 in outer surface portion 106 of barrel 16 and the overlying portion of the inner surface 112 of the gas block 100 may define a closed flow path or passage 114, as depicted in FIG. 9—e.g., the groove 108 and the outer surface portion 106 each partly define the passage 114. The passage 114 directs the high-pressure propellant gas G from the groove 108 into the gas block 100. The minimal clearance between the gas block 100 and the barrel 16 discourages leakage of propellant gas from the passage 114. In some embodiments, the passage 114 may be defined by either or both of the gas block 100 and the barrel 16.

In some embodiments, the gas block 100 can be secured to the barrel 16 by, for example, two set screws (not shown) that are accommodated by threaded holes 116 formed in the gas block 100. An example of holes 116 is shown in FIG. 13. In some embodiments, the gas block 100 is configured to abut a larger-diameter surface portion 38 (labeled in FIG. 6) of the outer surface 102 of the barrel 16, wherein surface portion 38 has a larger diameter than surface portion 106, when the gas block 100 is properly positioned on the barrel 16, as can be seen in FIGS. 4-7. This feature can help ensure that the gas block 100 is installed at its proper longitudinal position along the length of the barrel 16. Other features, such as dimples (not shown) formed in the outer surface 102 of the barrel 16 for receiving the ends of the set screws, can be used to help ensure that the gas block 100 is positioned at its proper angular orientation in relation to the barrel 16.

The depicted gas block 100 has a gas port 118, shown as having a cylindrical shape, and a gas tube receiving passage 120 formed therein. Example embodiments of the gas block gas port 118 and the gas tube receiving passage 120 are shown in FIGS. 9 and 13. The gas port 118 and gas tube receiving passage 120 may facilitate communication of the propellant gas G from the barrel gas ports 110 and the passage 114 to the action 22.

The gas block gas port 118 may extend in a direction substantially perpendicular to the lengthwise direction the barrel receiving passage 113 and the barrel 16. The gas block gas port 118 can have other orientations in alternative embodiments. The gas block gas port 118 has a diameter of, for example, about 0.068 inches. The gas tube receiving passage 120 extends substantially parallel to the lengthwise direction of the barrel receiving passage 113, and the longitudinal axis of the barrel 16. In some embodiments one or more intermediate gas tubes (e.g., the conduit shown in FIGS. 1-2) may extend from the gas tube receiving passage 120 to the gas key 27 (shown in FIG. 3). The aforementioned gas tube(s) may be separate tubes or may be conduits formed in or on any other portion of the firearm. In some embodiments, the gas block may include multiple gas tube receiving passages, each connected to at least one of the plurality of gas ports and each connected to at least one of a plurality of gas tubes that extend to the action.

The gas block 100 may be configured so that the gas block gas port 118 and/or a channel or other passage connected thereto aligns with the groove 108 in the outer surface portion 106 of the barrel 16, as shown in FIG. 13. As can be seen, the inner end of the gas port 118 faces, and is open to the groove 108, so that the propellant gas in the passage 114 can enter the gas block 100 by way of the gas port 118. In some embodiments, the diameter of the end portion of the gas block gas port 118 that is open to and abuts the groove 108 is equal to or larger than the diameter of the groove 108. In instances in which multiple ports and/or one or more grooves are formed in the gas block, these ports and/or groove(s) may likewise serve as a portion of the passage to guide propellant gas G from the multiple barrel gas ports 110 opening into the bore 107 to the gas block gas port 118.

The gas tube receiving passage 120 receives the propellant gas G from the gas block gas port 118, and directs the propellant gas G to a gas tube (not shown) of the gas system 18. An example of a gas tube is shown in US 2020/0033085, which is hereby incorporated by reference. A forward end of the gas tube is positioned in the gas tube receiving passage 120. The diameter of the gas tube receiving passage 120 is sized so that the gas tube fits within the gas tube receiving passage 120 with minimal clearance, to discourage leakage of the propellant gas G entering the gas tube. The forward end of the gas tube is secured to the gas block 100 by a pin. As used herein, "pin" refers to a round pin, screw, square pin, flat pin, solid cylindrical pin, tapered pin, groove pin, spring pin, or any other shaped component or structure that would serve the same purpose described herein. The pin is accommodated by a pair of diametrically-opposed holes 124 (visible in FIG. 7) formed in the gas block 100, on opposite sides of the gas tube receiving passage 120; and by a correspondingly aligned pair of diametrically-opposed holes formed in the gas tube.

The rearward end of the gas tube is connected to a gas key 27 (shown in FIG. 3) of the gas system 18. The gas key 27 receives the propellant gas G from the gas tube, and directs the propellant gas to the action 22 of the firearm 10 as described herein. In embodiments utilizing other gas-driven mechanisms, such as but not limited to a short- or long-stroke piston, the gas tube may likewise receive and/or be connected to such gas-driven components as would be appreciated in light of the present disclosure. In the depicted embodiment, the gas port 118 and gas tube receiving passage 120 define a single gas conduit connected to the action, such that the flow paths from the barrel gas ports 110 are combined upstream of the gas port 118 and gas tube receiving passage 120. In some embodiments, any one or more ports and passages that collectively define a fluidic connection between the barrel gas ports 110 and the action 22 as described herein may be utilized.

In the depicted embodiments, the barrel gas ports 110, passage 114, gas block gas port 118, gas tube receiving passage 120, gas tube, and gas key 27 form a flow path that directs the high-pressure propellant gas G from the bore 17 to the action 22. In particular, the propellant gas G generated by the burning propellant of the cartridge 32 travels behind the projectile 30, and propels the projectile 30 through the bore 17 of the barrel 16, as indicated by the arrows in FIG. 2. As the propellant gas G reaches the barrel gas ports 110 in the barrel 16, a portion of the propellant gas G enters, and travels through the barrel gas ports 110. A passage 114 may then rejoin the propellant gas G traveling through each of the barrel gas ports 110, which propellant gas G may be channeled to the action to drive reloading and cocking the firearm. For example, in some embodiments, the propellant gas G exits the barrel gas ports 110 and enters the passage 114 defined by the groove 108 and the inner surface 112 of the gas block 100. The relatively high pressure within the bore 17 immediately after the firearm 10 is discharged may push the propellant gas G through the passage 114 and toward the gas block gas port 118 in the gas block 100.

In some embodiments, the propellant gas G enters the gas block 100 via the gas block gas port 118, and is directed to the gas tube by way of the gas block gas port 118 and the adjoining gas tube receiving passage 120. The propellant gas G then travels through gas tube, and enters the action 22 by way of the gas key.

The multiple barrel gas ports 110 and the passage 114 may act as a manifold in which propellant gas G is taken from multiple locations within the barrel 16, combined into a single flow, and then directed to the action 22. As described herein in various embodiments, the barrel gas ports 110, passage 114, and any additional channels, conduits, or the like may be configured as one or more pieces. This arrangement permits the barrel gas ports 110 to be sized smaller than otherwise would be possible. More specifically, the multiple barrel gas ports 110 each can have a smaller diameter than a single gas port through which all of the propellant gas G is directed, while maintaining an aggregate flow rate of propellant gas G equal to the flow rate through a single, larger-diameter gas port for a given model of firearm. In some embodiments, the size of the gas ports may be determined experimentally by choosing the smallest opening which permits the action to cycle.

In various embodiments, the use of smaller-diameter gas ports such as the barrel gas ports 110 can provide significant advantages. For example, the smaller-diameter barrel gas ports 110 are believed to be less susceptible to erosion. As discussed above, the surface that defines a barrel gas port, in general, is susceptible to erosion as the hot, high-pressure propellant gas, which includes abrasive combustion byproducts, passes through the barrel gas port at high velocity. For a given cross-sectional flow area (e.g., assuming a single, large port is replaced by a plurality of smaller ports having the same cumulative cross-sectional flow area), the cumulative circumference of the smaller openings in the bore will be greater than the circumference of the larger opening. It is believed that this greater "length" of the opening circumferences will resist erosion better than a smaller-circumference opening. Thus, when multiple barrel gas ports are used, the erosive effects of the propellant flow are spread out over a greater opening edge length, potentially reducing erosion of the gas edge port surfaces. Moreover, when multiple gas ports are used, the interior of the barrel gas ports 110 may likewise define a greater combined interior surface area than the interior surface area of a single barrel gas port while providing a comparable flowrate. In some embodiments, multi-port designs may define a greater cumulative area than the equivalent area of a one port design.

Also, it is believed that the smaller gas ports cause less damage to the projectile 30, providing an additional benefit to projectile stability and accuracy. As discussed above, a discharged projectile, such as the projectile 30 traveling, down a bore 17 expands against the adjacent inner surface of the barrel 16 as a result of the pressure of the expanding gas behind it. When the projectile 30 passes a barrel gas port, this expansion will push some of the projectile 30 into the gas port, which in turn will shave off material from the projectile 30. By obdurating the bullet into the ports, a deformation or recess may be cut into the bullet for each port, which may cause multiple ports to have the potential for greater accuracy since the deformations may be spaced, and in some instances, evenly spaced. In contrast, for a barrel having a single gas port, this shaving action may remove material from one side of the projectile 30, shifting the center of mass from the projectile's axis of rotation and causing an imbalance. The resulting imbalance in the projectile 30 can reduce the gyroscopic stability of the projectile 30, causing the projectile 30 to deviate from its intended path, and thereby reducing shooting accuracy.

It is believed that the use of smaller barrel gas ports such as the barrel gas ports 110 can reduce the amount of material shaved off the projectile 30 and thus reduce the degree of the imbalance. Also, by spacing the multiple barrel gas ports 110 from each other, preferably in equal angular increments, the material loss associated with any one barrel gas port 110 can be offset or counter-balanced by the material losses associated with the other barrel gas ports 110, which may maintain the center of mass along the axis of rotation of the projectile 30. Thus, any net imbalance and loss of stability in the projectile 30 caused by the localized material loss can be minimized or substantially eliminated. It is noted that this result also can be achieved through the placement of holes extending outward from inner surface 104 of the barrel 16 (i.e., penetrating through the barrel body). In some embodiments, such holes, along with a single gas port, may be spaced apart in equal angular increments circumferentially about the barrel. The holes themselves may extend, for example, in a direction substantially perpendicular to the lengthwise direction of the barrel, or may extend at an angle of up to 30 degrees, up to 45 degrees, or up to 60 degrees from a direction substantially perpendicular to the lengthwise direction of the barrel. Additionally, these holes do not need to function as gas ports, and do not need to facilitate any gas flow whatsoever to achieve the aforementioned beneficial balancing effect. In some embodiments, multiple barrel gas ports need not be smaller than a single barrel gas port to achieve the beneficial balancing effect due.

In the following descriptions of alternative embodiments of the barrel 16 and gas block 100, and in the accompanying figures, identical reference characters are used to denote components of the alternative embodiments that are substantially identical to components of the barrel 16 and the gas block 100. As described herein, in various embodiments, any groove(s), channel(s), or equivalent passage(s), formed from one or more structural elements, that combine and connect the barrel gas ports 110 with the action 22 may be used.

Figure 17:
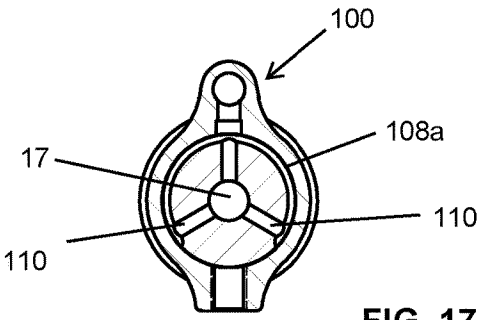
FIG. 17 is a cross-sectional view taken through the line "H-H" of FIG. 15.
Figure 16:
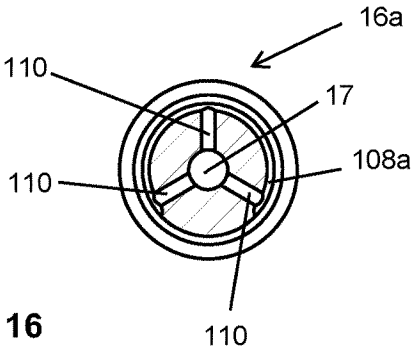
FIG. 16 is a cross-sectional view taken through the line "G-G" of FIG. 14.
Figure 18:
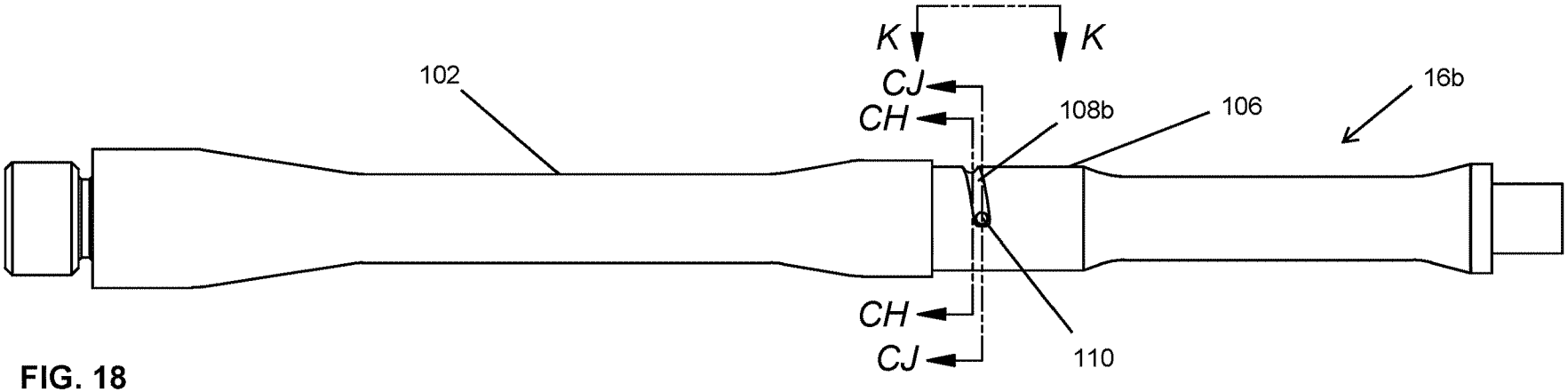
FIG. 18 is a side view of another alternative embodiment of the barrel shown in FIGS. 4-13.

FIGS. 14-17 depict an alternative embodiment of the barrel 16 in the form of a barrel 16*a*. The barrel 16*a* is substantially identical to the barrel 16, with the exception that the barrel 16*a* has a groove 108*a* that extends along only a portion of the circumference of the outer surface 102 of the barrel 16. More specifically, as shown in FIGS. 16 and 17, the groove 108*a* extends along the three depicted barrel gas ports 110, but does not extend between the two lowermost depicted barrel gas ports 110.

Figure 19:
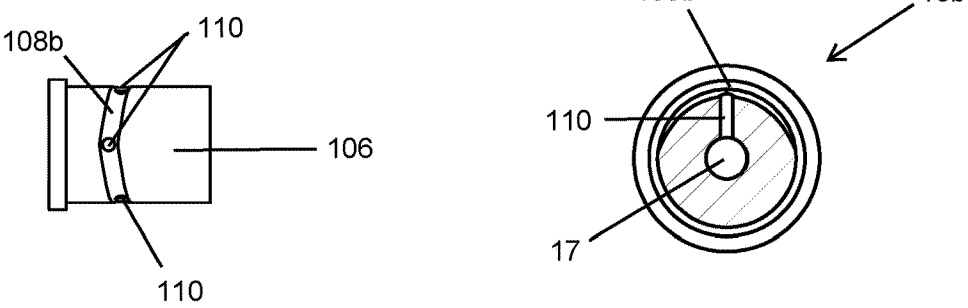
FIG. 19 is a top view of the area denoted "K-K" in FIG. 18.
Figure 20:
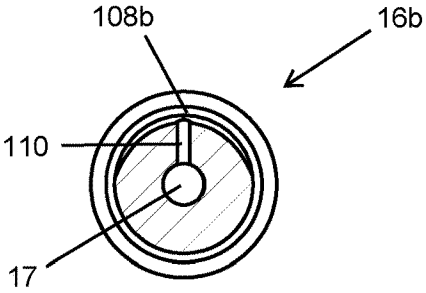
FIG. 20 is a cross-sectional view taken through the line "CH-CH" of FIG. 18.
Figure 21:
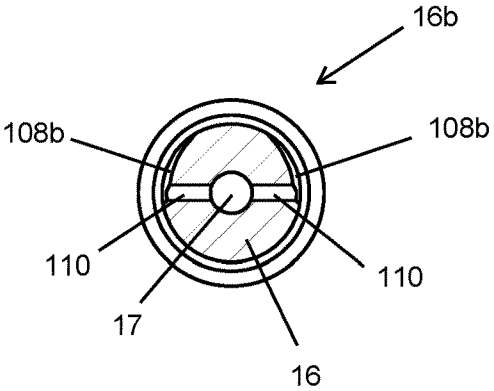
FIG. 21 is a cross-sectional view taken through the line "CJ-CJ" of FIG. 18.

FIGS. 18-21 depict another alternative embodiment of the barrel 16 in the form of a barrel 16*b*. The barrel 16*b* is substantially identical to the barrel 16*a*, with the exception that the barrel gas ports 110 are not all located at the same lengthwise or axial position along the barrel 16*b*. The barrel 16*b* has a groove 108*b* that extends along the outer surface 102 of the barrel 16*b* in a curvilinear manner, as shown in FIG. 19, so that the position of the groove 108*b* in the axial direction of the barrel 16 constantly changes along the length of the groove 108*b*. This arrangement permits the groove 108*b* to align with each of the barrel gas ports 110 located at different axial positions along the barrel 16. In this particular embodiment, two of the barrel gas ports 110 are located at the same axial position, as can be seen in FIG. 21. The respective axial positions of the barrel gas ports 110 can be different, and the groove 108*b* can have a shape other than curvilinear in variants of the barrel 16*b*. In the depicted embodiment, the propellant gas enters the lower, rearmost two barrel gas ports 110 simultaneously and the top, frontmost gas port 110 after the other two. In some embodiments, axially offsetting two or more of the gas ports produces a softer push of the action, which is believed to be caused by the offset timing of the gas passing through the ports. This softer push may improve operation of at least some firearms.

For example FIGS. 42-48 depict a variant of the barrel 16*b* in the form of a barrel 16*f*. The barrel 16*f* has three barrel gas ports 110 each located at a different axial position along the barrel 16*f*. The barrel 16*f* has a groove 108*d* that extends along the outer surface 102 of the barrel 16*f* in a linear, i.e., substantially straight, manner from the perspective of the surface of the barrel 16*f* shown in FIG. 44, so that the position of the groove 108*d* in the axial direction of the barrel 16*f* constantly changes along the length of the groove 108*d*, allowing the groove 108*d* to align with each of the barrel gas ports 110 located at different axial positions along the barrel 16, such that the propellant gas enters each of the barrel gas ports 110 sequentially.

In other variants of the barrel 16*b*, the groove 108 can be widened to accommodate barrel gas ports 110 in different axial positions on the barrel 16, without the groove 108 itself changing its axial position on the barrel 16, i.e., without the groove 108*b* extending forward or rearward on the barrel.

Figure 22:
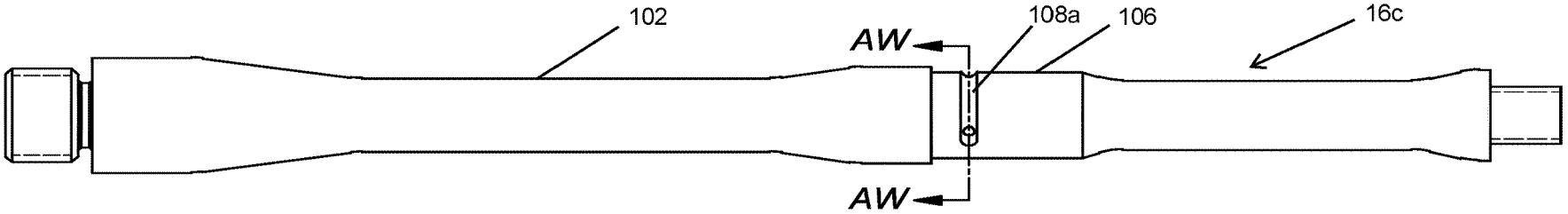
FIG. 22 is a side view of another alternative embodiment of the barrel shown in FIGS. 4-13.
Figure 23:
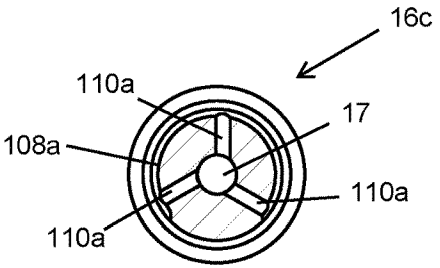
FIG. 23 is a cross-sectional view taken through the line "AW-AW" of FIG. 22.
Figure 25:
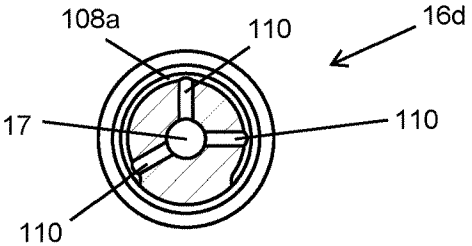
FIG. 25 is a cross-sectional view taken through the line "BC-BC" of FIG. 24.
Figure 24:
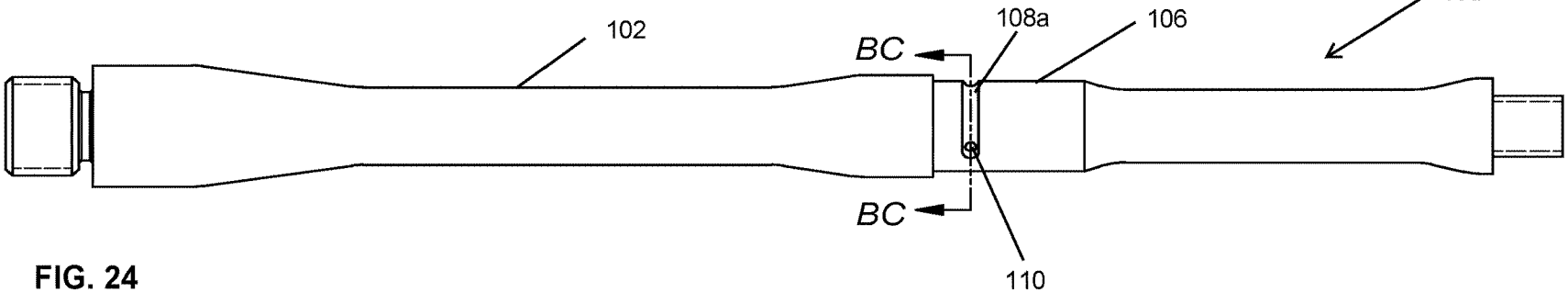
FIG. 24 is a side view of another alternative embodiment of the barrel shown in FIGS. 4-13.
Figure 26:
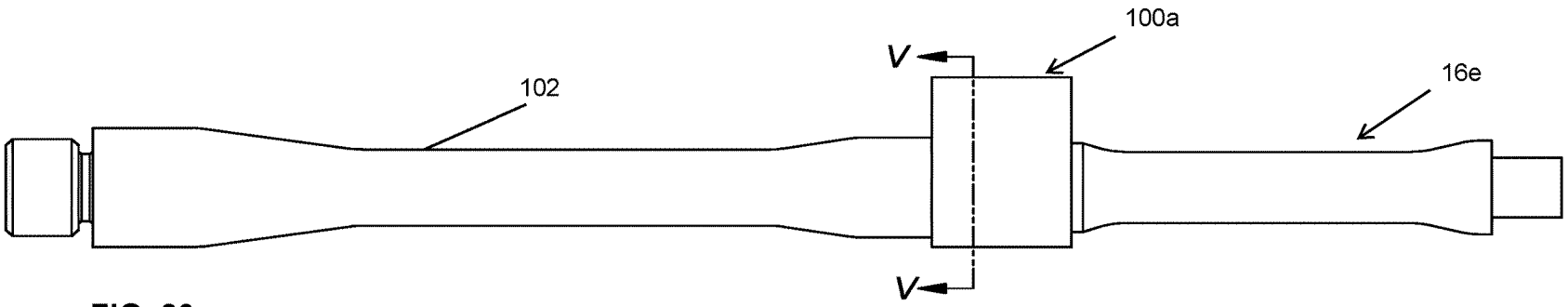
FIG. 26 is a side view of another alternative embodiment of the barrel shown in FIGS. 4-13, and an alternative embodiment of the gas block shown in FIGS. 5, 7, 9, 12, 15, and 17 mounted thereon.
Figure 27:
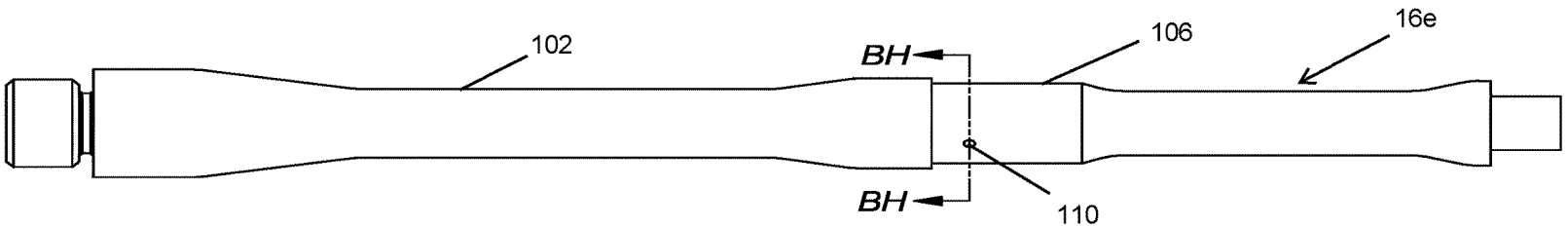
FIG. 27 is a side view of the barrel shown in FIG. 26.
Figure 29:
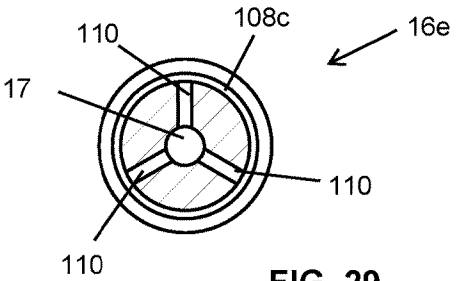
FIG. 29 is a cross-sectional view taken through the line "BH-BH" of FIG. 27.
Figure 28:
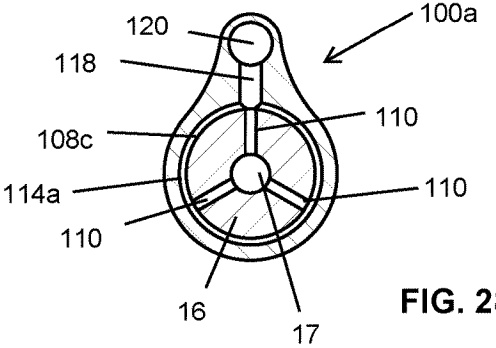
FIG. 28 is a cross-sectional view taken through the line "V-V" of FIG. 26.
Figure 30:
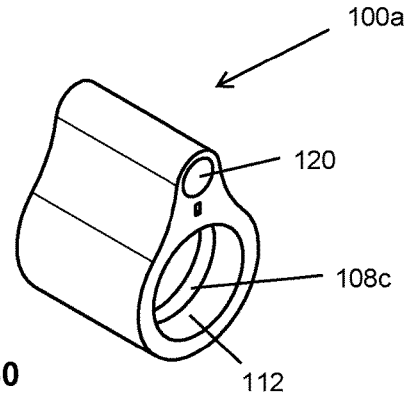
FIG. 30 is a top-right perspective view of the gas block shown in FIGS. 26 and 28.
Figure 31:
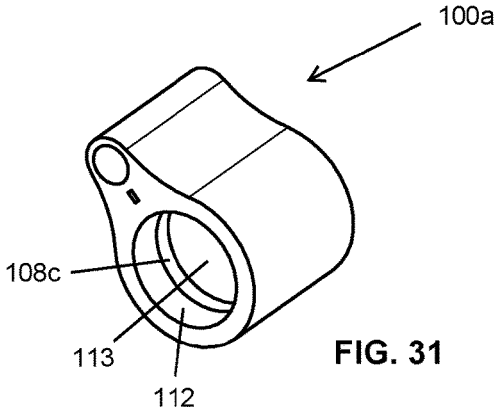
FIG. 31 is a bottom-right perspective view of the gas block shown in FIGS. 26, 28, and 30.
Figure 32:
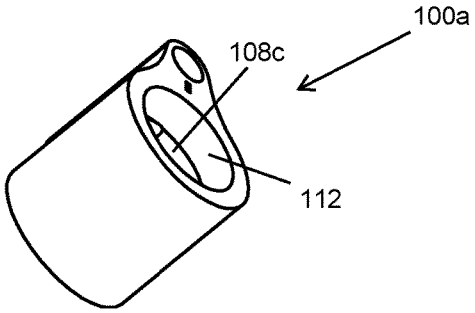
FIG. 32 is a bottom-front perspective view of the gas block shown in FIGS. 26, 28, 30, and 31.
Figure 33:
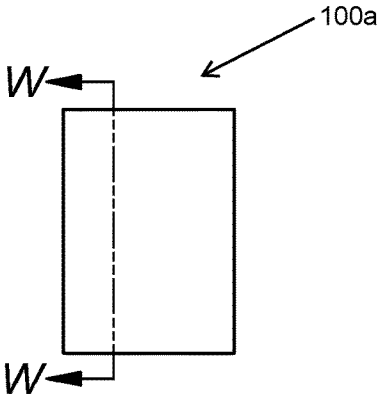
FIG. 33 is a front view of the gas block shown in FIGS. 26, 28, and 30-32.
Figure 34:
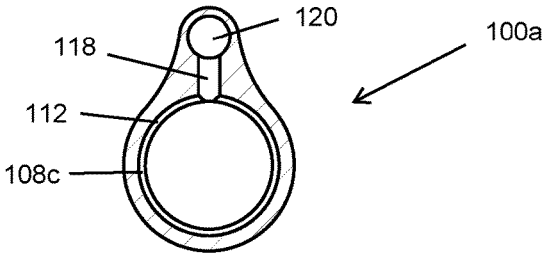
FIG. 34 is a cross-sectional view taken through the line "W-W" of FIG. 33.
Figure 36:
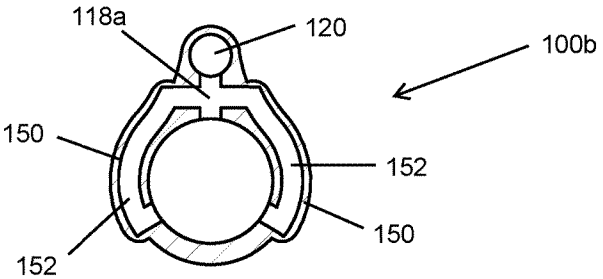
FIG. 36 is a cross-sectional view taken through the line "DY-DY" of FIG. 35.
Figure 35:
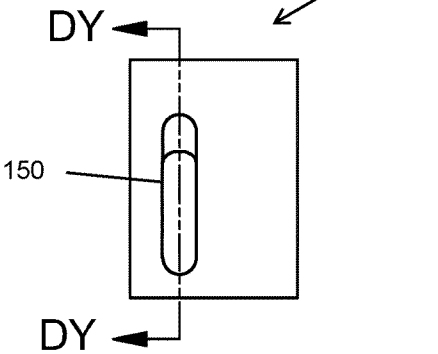
FIG. 35 is a side view of another alternative embodiment of the gas block shown in FIGS. 5, 7, 9, 12, 13, 15, and 17.
Figure 37:
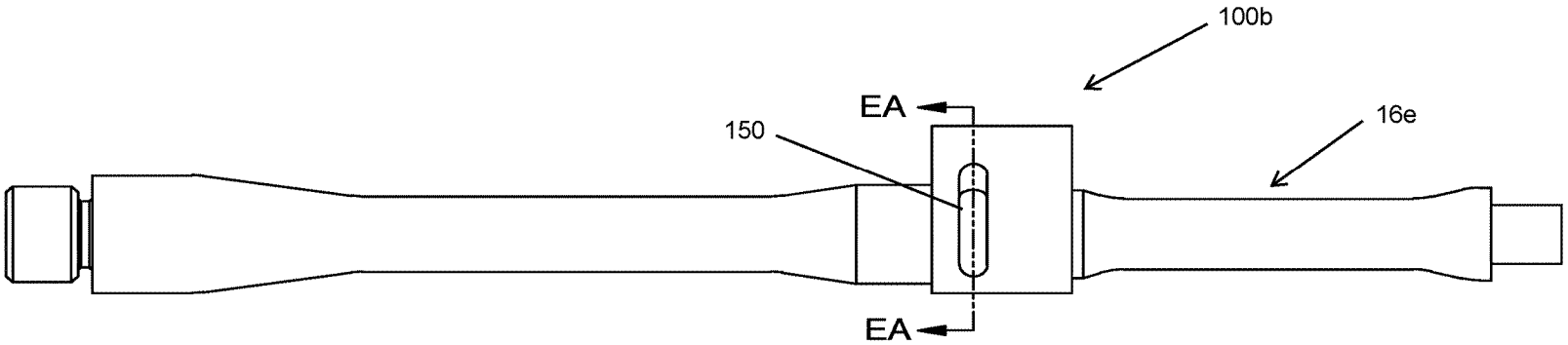
FIG. 37 is a side view of the barrel shown in FIGS. 26-29, with the gas block shown in FIGS. 35 and 36 mounted thereon.

FIGS. 22 and 23 depict another alternative embodiment of the barrel 16 in the form of a barrel 16*c*. The barrel 16*c* is substantially identical to the barrel 16*a*, with the exception that the barrel gas ports 110*a* of the barrel 16*c* do not extend radially in relation to the axial centerline of the barrel 16*c*, i.e., barrel the gas ports 110*a* do not extend in a direction perpendicular to the axial centerline of the barrel 16, from the perspective of FIG. 23. Instead, the barrel gas ports 110*a* have an angular offset in relation to the radial direction, as can be seen in FIG. 23. As depicted, groove 108*a* extends along only a portion of the circumference of the outer surface 102 of the barrel 16. In some embodiments, the groove 108 may be FIGS. 24 and 25 depict another alternative embodiment of the barrel 16 in the form of a barrel 16*d*. The barrel 16*d* is substantially identical to the barrel 16*a*, with the exception that the angular spacing between adjacent gas ports 110 is not equal.

FIGS. 26-34 depict another alternative embodiment of the barrel 16 in the form of a barrel 16*e*, and an alternative embodiment of the gas block 100 in the form of a gas block 100*a*. In these embodiments, a groove 108*c*, similar to the groove 108, is located on the inner surface 112 of the gas block 100*a*; and no groove is formed on the barrel 16*e*. The groove 108*c* and the adjacent portion of the outer surface 102 of the barrel 16*e* define a passage 114*a* similar to the passage 114 defined by the respective barrel 16 and gas block 100. Propellant gas G from the bore 17 is directed to the passage 114*a* by the barrel gas ports 110; and the passage 114*a* directs the propellant gas G to the gas block gas port 118 of the gas block 100*a* in a manner similar to the passage 114. In some embodiments, both the gas block and the barrel may include at least a portion of the passage. In the depicted embodiment, the groove 108*c* extends along the entire circumference of the inner surface 112 of the gas block 100*a*. In other alternative embodiments (not shown), the groove can extend along only a portion of the circumference of the inner surface 112. In other alternative embodiments, the respective positions of the gas ports 110 in the axial direction of the barrel 16 can vary, and the groove can be curved (e.g., like the groove 108*a*) or linear and angled (e.g., like the groove 108*d*) so as to align with the various barrel gas ports 110. In other alternative embodiments incorporating the groove located on the gas block 100*a*, the gas ports 110 can be offset from the radial direction like the barrel gas ports 110*a*; and the angular spacing between adjacent gas ports 110 can be non-equal as in the embodiment shown in FIGS. 24 and 25.

Figure 38:
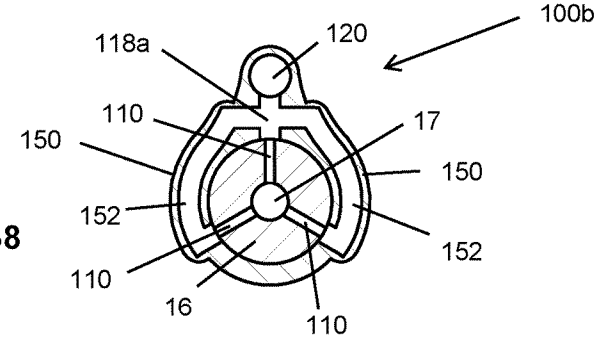
FIG. 38 is a cross-sectional view taken through the line "EA-EA" of FIG. 37.
Figure 40:
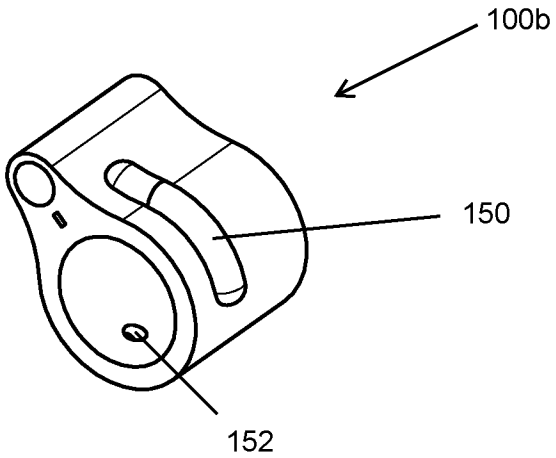
FIG. 40 is a front-left perspective view of the gas block shown in FIGS. 35-39.
Figure 39:
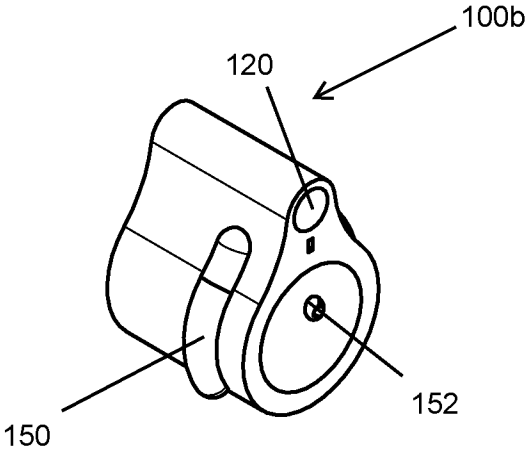
FIG. 39 is a top-right perspective view of the gas block shown in FIGS. 35-38.
Figure 41:
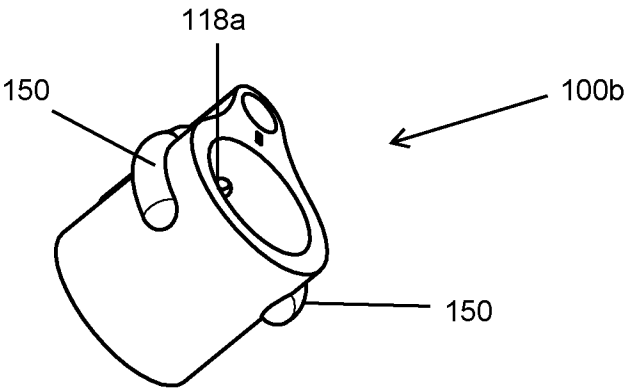
FIG. 41 is a bottom-front perspective view of the gas block shown in FIGS. 35-40.
Figure 42:
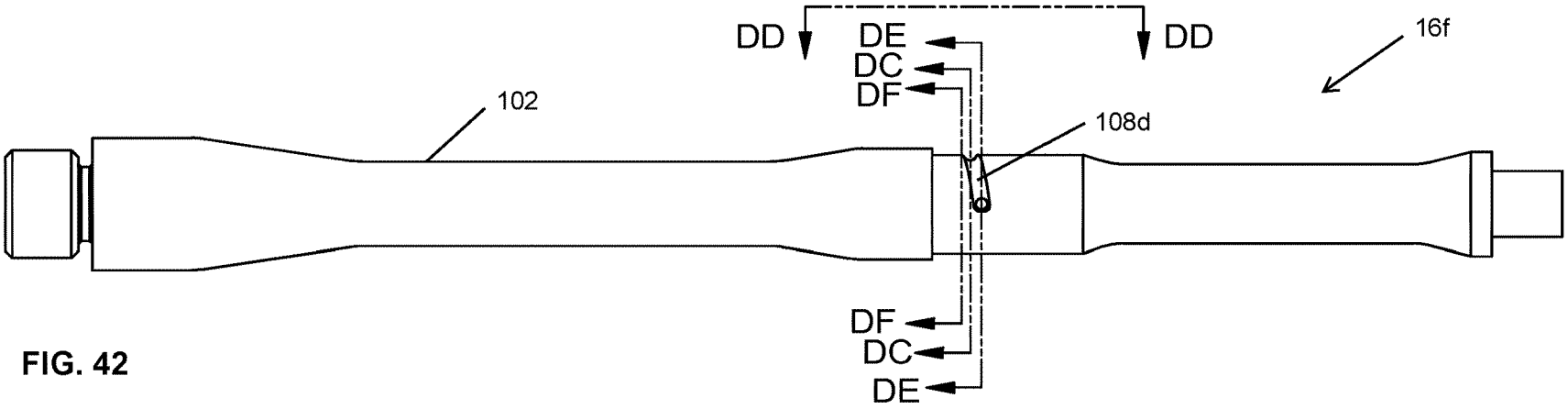
FIG. 42 is a side view of another alternative embodiment of the barrel shown in FIGS. 4-13.
Figure 43:
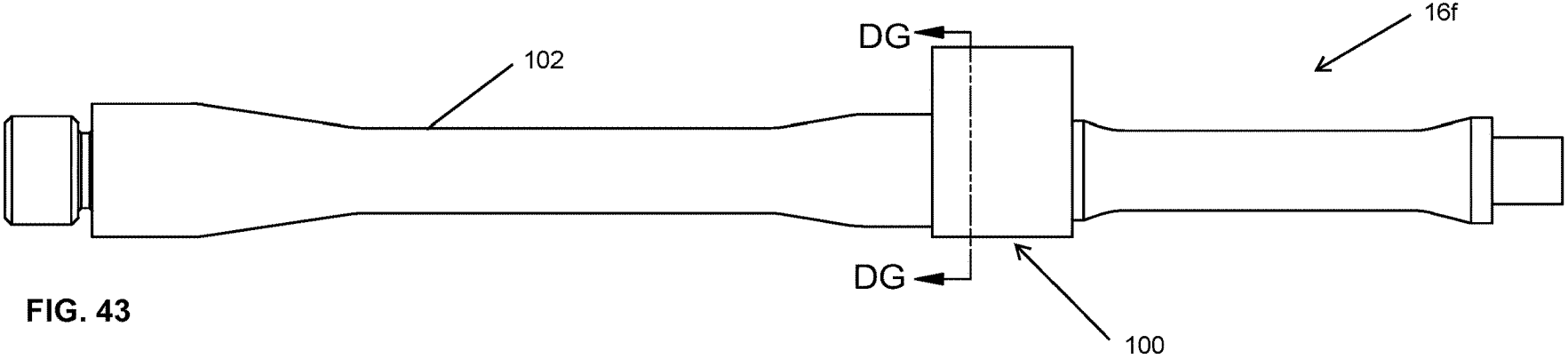
FIG. 43 is a side view of the barrel shown in FIG. 42, with the gas block shown in FIGS. 5, 7, 9, 12, 13, 15, and 17.
Figure 44:
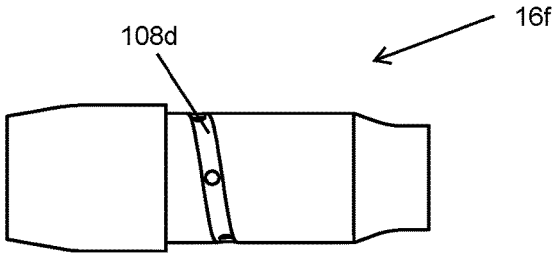
FIG. 44 is a top view of the area designated "DD-DD" in FIG. 42.
Figure 45:
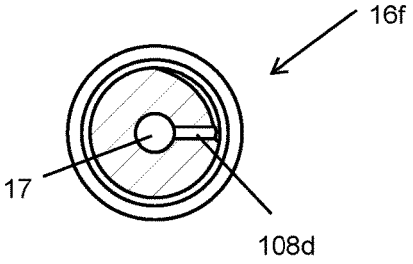
FIG. 45 is a cross-sectional view taken through the line "DF-DF" of FIG. 42.
Figure 46:
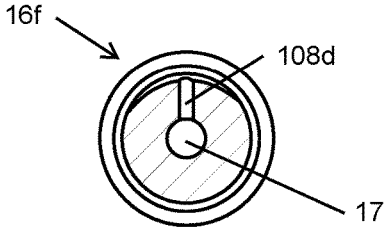
FIG. 46 is a cross-sectional view taken through the line "DC-DC" of FIG. 42.
Figure 47:
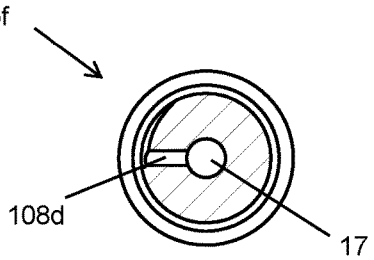
FIG. 47 is a cross-sectional view taken through the line "DE-DE" of FIG. 42.
Figure 48:
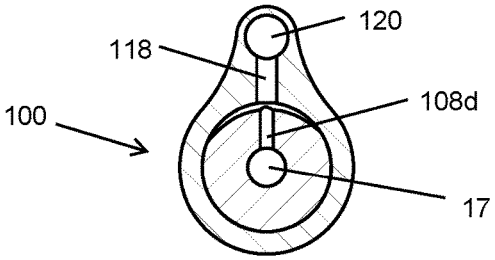
FIG. 48 is a cross-sectional view taken through the line "DG-DG" of FIG. 43.

FIGS. 35-41 depict another alternative embodiment of the gas block 100 in the form of a gas block 100*b*. The gas block 100*b* can be used with the barrel 16*e*, i.e., with the variant of the barrel 16 without any groove 108 formed therein. In some embodiments, the gas block 100*b* and barrel 16*e* may be integral as described herein. The gas block 100*b* may include one or more external conduits—e.g., 1, 2, 3, 4, or more external conduits. As depicted, gas block 100*b* includes two external conduits 150. Each conduit 150 defines an enclosed passage 152. An entrance to each passage 152 aligns with, and communicates with an associated one of the barrel gas ports 110 of the barrel 16. An exit of each passage 152 adjoins a gas block gas port 118*a* of the gas block 100*b*. The passages 152 thus direct propellant gas from the two lower barrel gas ports 110 of the barrel 16 directly to the gas block gas port 118*a* of the gas block 100*b*. As can be seen in FIG. 38, the gas block gas port 118*a* aligns with, and communicates directly with the uppermost barrel gas port 110. Thus, this arrangement provides a manifold configuration similar to the barrel 16 and gas block 100, and their variants, using external rather than internal flow passages. In some embodiments, the flow passages may each separately feed into the gas tube receiving passage 120 and/or gas tubes extending to the action.

Figure 50:
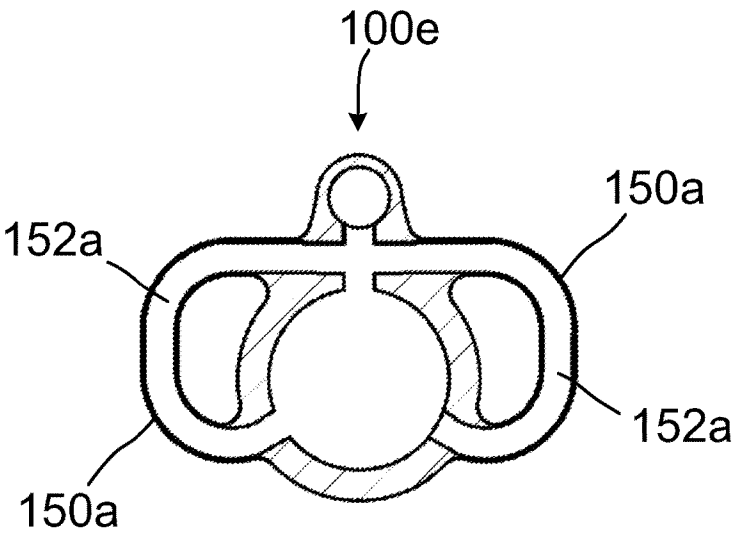
FIG. 50 is a cross-sectional view of the gas block of FIG. 49.
Figure 49:
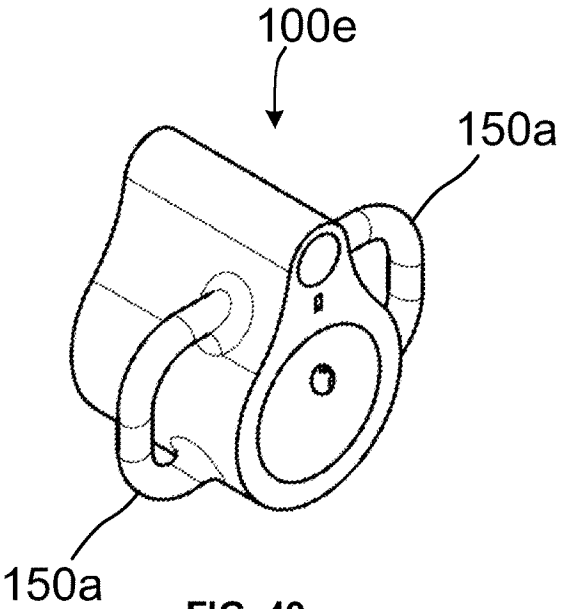
FIG. 49 is a perspective view of another embodiment of the gas block shown in FIGS. 35-41.
Figure 51:
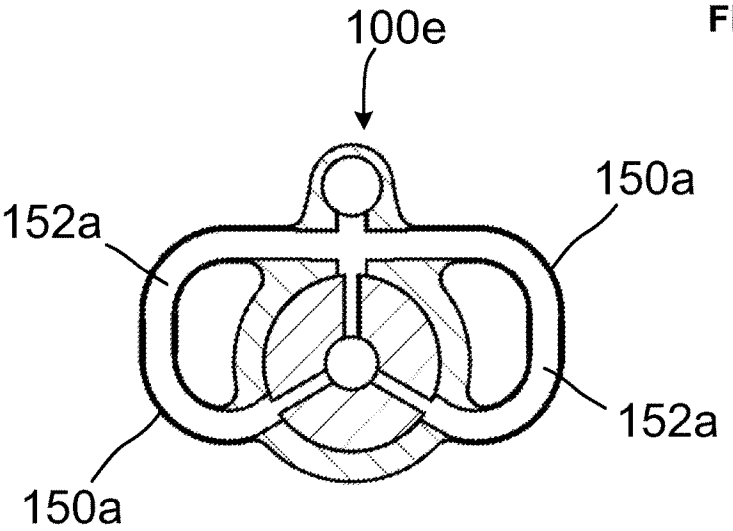
FIG. 51 is a cross-sectional view of the gas block of FIG. 49 mounted on a barrel.
Figure 52:
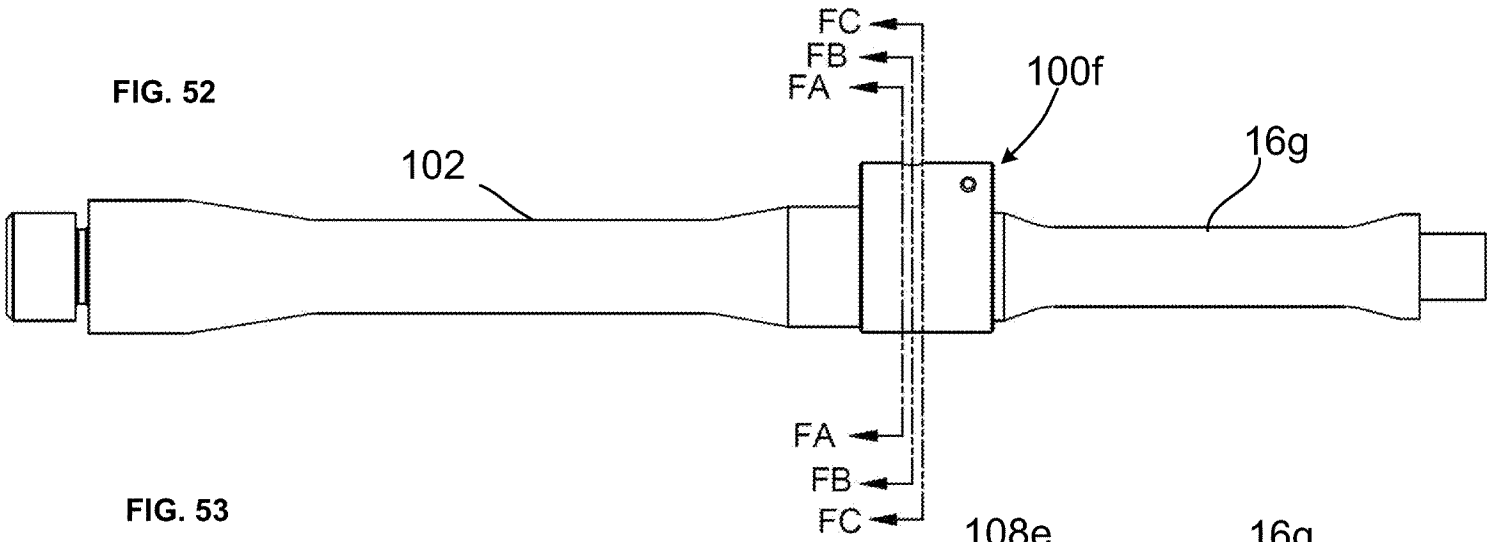
FIG. 52 is a side view of another embodiment of the barrel shown in FIGS. 4-13 with another embodiment of the gas block shown in FIGS. 5, 7, 9, 12, 13, 15, and 17.
Figure 53:
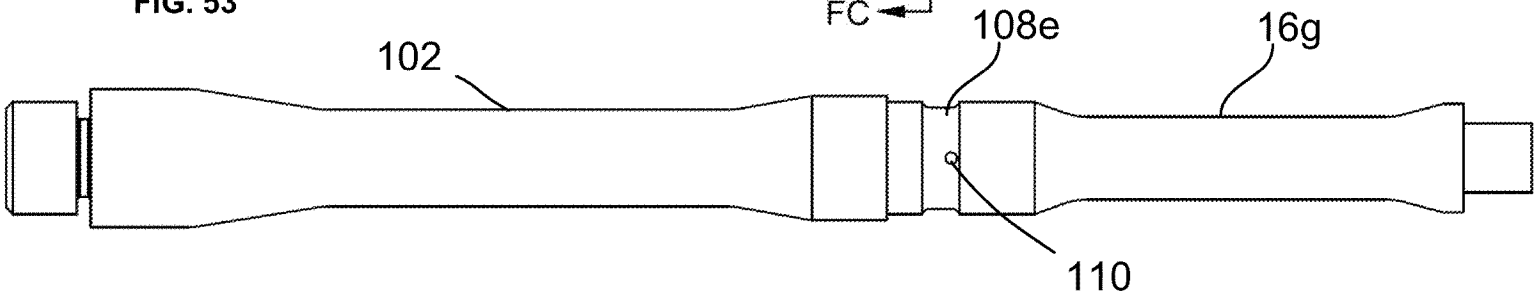
FIG. 53 is a side view of the barrel of FIG. 52.
Figure 56:
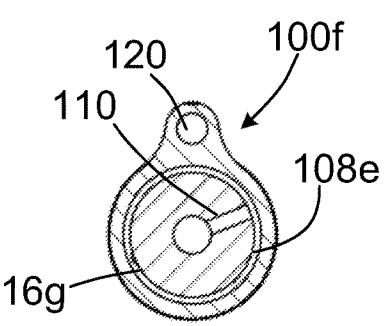
FIG. 56 is a cross-sectional view taken through the line "FC-FC" of FIG. 52.
Figure 55:
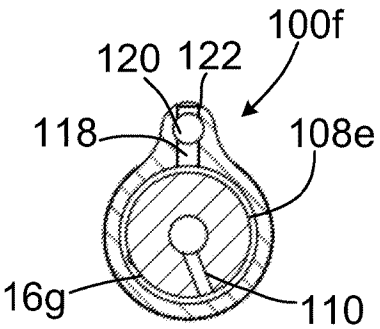
FIG. 55 is a cross-sectional view taken through the line "FB-FB" of FIG. 52.
Figure 54:
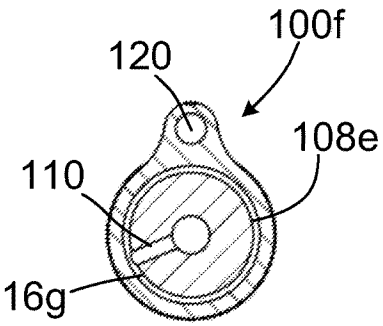
FIG. 54 is a cross-sectional view taken through the line "FA-FA" of FIG. 52.

FIGS. 49-51 depict an alternative embodiment of the gas block 100*b* in the form of a gas block 100*e*. In the embodiment of FIGS. 49-51, the gas block 100*e* may be structured and may operate identically to the gas block 100*b* of FIGS. 35-41 except that the depicted conduits 150*a* and enclosed passages 152*a* extend outwardly from the gas block 100*e* with a gap between the conduits and the main body of the gas block.

In some embodiments, at least the barrel 16 may be rotationally agnostic, such that the relative rotation between the barrel and the gas block 100 does not affect fluidic coupling between the two. This may simplify assembly of the firearm because the user need not precisely align the barrel and gas block for operation. FIGS. 52-61 depict another example embodiment having a barrel 16*g* and gas block 100*f* which are rotationally agnostic relative to each other. The depicted gas block 100*f* includes a gas block gas port 118 and gas tube receiving passage 120 to receive the gas and direct the gas to the action as described in other embodiments herein. In some embodiments, an upper outlet 122 may be formed in the gas block 100*f* above the gas tube receiving passage 120 to enable machining of the gas block gas port 118.

In the depicted embodiment, the barrel includes a plurality of barrel gas ports 110 spaced axially and rotationally from each other. Each of the barrel gas ports 110 is connected to groove 108*e*, which extends about the circumference of the barrel 16*g* and is sufficiently wide to encompass the outlets of each of the barrel gas ports 110. In the depicted configuration, the pressurized gas may travel from the barrel to the action in the manner described with respect to any embodiment herein in instances in which the groove 108*e* aligns at some radial and axial position with the gas block gas port 118. In this manner, the barrel 16*g* and gas block 100*f* may be said to be rotationally agnostic because, with reference to FIGS. 54-56, none of the gas ports 110 need align with any particular rotational position (e.g., the uppermost gas port 110 need not align with the gas block gas port 118) because they each connect to the groove 108*e* which extends entirely around the circumference of the barrel 16*g*, which groove connects to the gas block gas port 118 in any rotational position and several axial positions. In some embodiments, the gas block 100*f* will define the gas tube receiving passage 120 at an uppermost side of the gas block relative to the firearm to align with the gas key.

Similarly, the structures shown in the remaining embodiments herein may be used with the embodiment of FIGS. 52-61, such as including a groove on the interior of the gas block 100*f* in addition to or instead of the groove 108*e* on the barrel 16*g*. The gas block 100*f* and barrel 16*f* may also be made as a single, integral piece or as multiple pieces in accordance with any embodiment discussed herein. The remaining structures not detailed with respect to any embodiment discussed herein may be configured to operate in accordance with the structure and function of any other embodiment.

Figure 62:
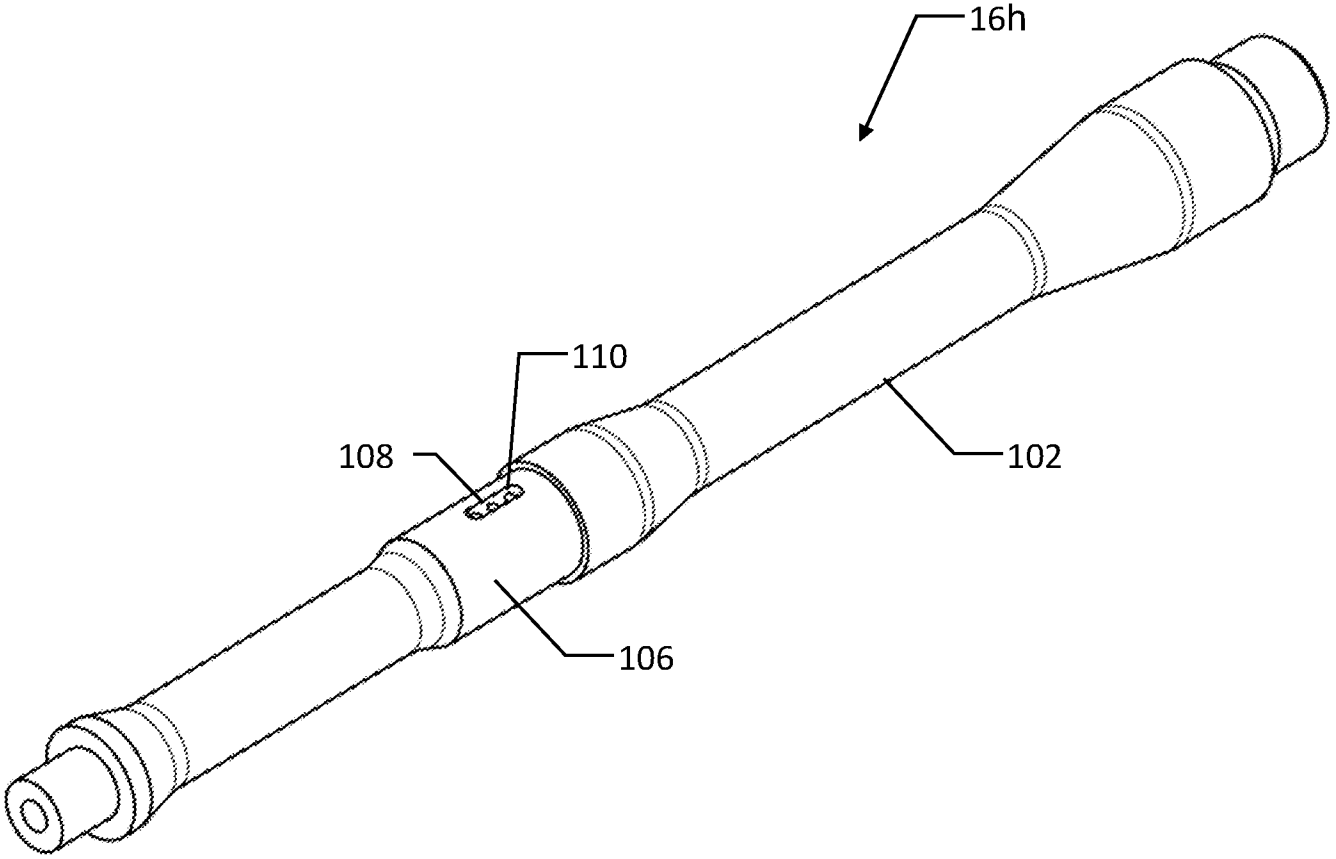
FIG. 62 illustrates a barrel including gas ports according to another example embodiment of the present disclosure.
Figure 63:
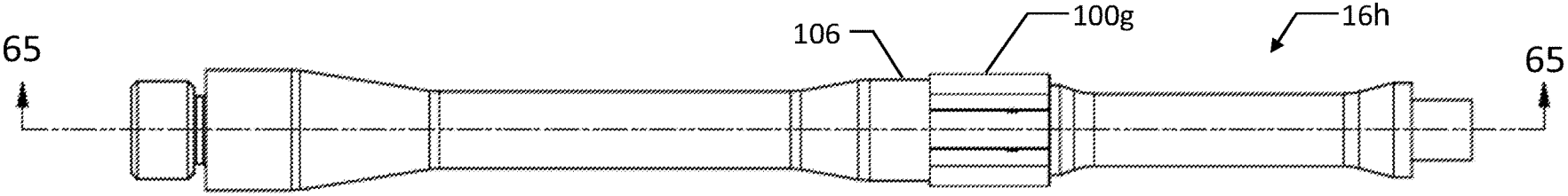
FIG. 63 is a top view of the barrel of FIG. 62 including a gas block.
Figure 64:
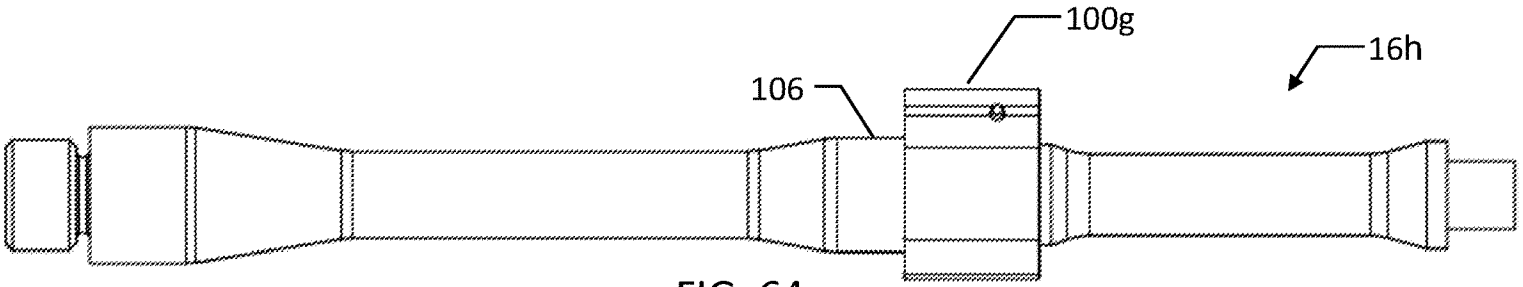
FIG. 64 is a profile view of the barrel of FIG. 62 including the gas block.
Figure 65:
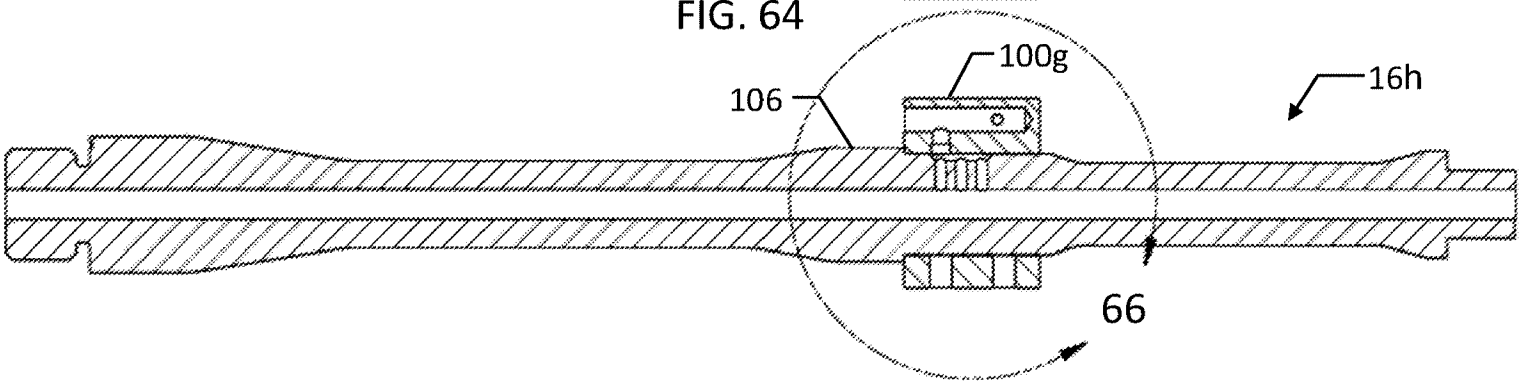
FIG. 65 is a cross-section view of the barrel of FIG. 63 taken along section line "65-65".

While the aforementioned example embodiments include gas ports 110 arranged in a radially-spaced manner with or without axial displacement, embodiments described herein further include gas ports arranged at the same radial position, displaced linearly along a direction of extension of the barrel. FIG. 62 illustrates such an example embodiment in which the barrel 16*h* includes a plurality of gas ports 110 through the barrel. The illustrated embodiment depicts three gas ports 110 axially displaced along the barrel. Further shown is a groove 108 within the surface portion 106 that functions as a manifold for the gas ports 110 as shown below. FIG. 63 illustrates a top view of the barrel 16*h* of FIG. 62 with the gas block 100*g* in position around the surface portion 106. FIG. 64 illustrates barrel 16*h* in profile with the gas block 100*g* in place, while FIG. 65 illustrates the section view taken along section line 65-65 of FIG. 63. The gas block 100*g* and gas port 110 configuration of the embodiment of FIGS. 62-65 is shown in greater detail in FIG. 66 illustrating the detail view of detail circle 66 of FIG. 65.

Figure 66:
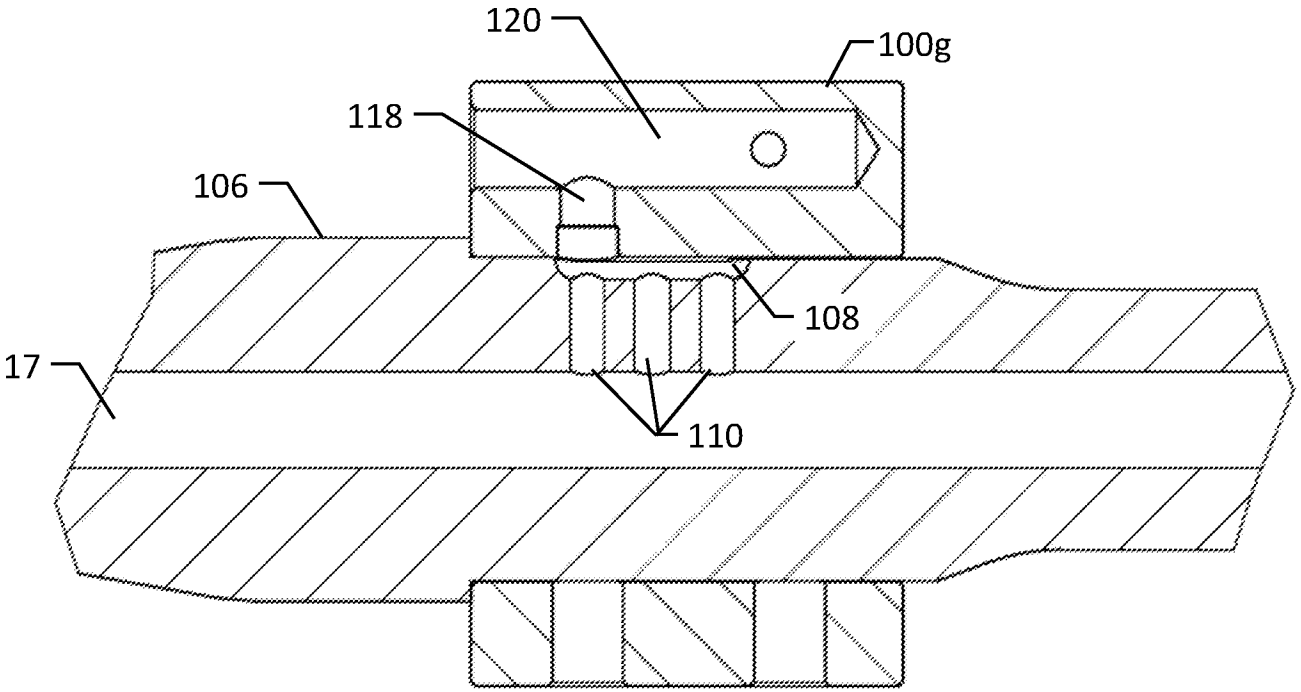
FIG. 66 is a detail view of the cross-section of FIG. 65 shown in detail circle "66".

As shown in FIG. 66, the detail section view illustrates three gas ports 110 extending from the bore 17 to the groove 108. The gas ports 110 permit gas to escape from the barrel bore 17 into the groove 108 that functions as a manifold, receiving gas from all three gas ports 110. The gas block gas port 118 is in fluid communication with the groove 108, thereby permitting gas flow from the bore 17, through the gas ports 110 into groove 108, through gas block gas port 118 and into the gas tube receiving passage 120. Such a configuration enables gas to flow back to the gas key 27 as described above.

Displacing the gas ports along a length of an axis defined through the bore of the barrel enables the gas to reach the spaced-apart gas ports sequentially, thereby delaying the gas entry from each successively-spaced gas port as the gas advances along the length of the barrel. Introducing this delay results in a delay in the action (e.g., action 22 of FIGS. 1 and 2) receiving the energy from the gas system (e.g., gas system 18), which lessens the force on the bolt member (e.g., bolt member 132), allowing the bolt member to turn more easily within the bolt chamber (e.g., bolt chamber 134). This delay from the successively-spaced gas ports being sequentially reached by the gas rather than all gas ports being reached by the gas simultaneously further decreases stresses on other parts of the action, such as the bolt cam pin 144, the hole that receives the bolt cam pin, and other members of the action that react to the gas passing through the gas tube receiving passage 120 to the action. These performance changes may also be experienced for any of the axially displaced gas port embodiments discussed herein that are also displaced circumferentially (e.g., FIGS. 18-21, 42-48, and 52-61). The configuration of gas ports displaced along the length of an axis defined through the bore of the barrel further increases the amount of gas leaving the barrel via the bore and reduces the gas directed back to the shooter.

The gas port configuration of the embodiment of FIGS. 62-66 provide the advantages described with respect to various embodiments above for smoother and more powerful gas cycling while also being of a configuration that may be easier to manufacture and more reliable. For example, if the gas ports 110 and groove 108 are machined into the barrel 16, a machining operation would only require movement of a machining bit (e.g., a drill or milling bit) along two axes relative to the barrel, whether it is the bit and/or the barrel that is moved relative to the other. The two axes would include a translation axis parallel to the bore of the barrel to move between gas ports 110 and to mill the groove 108, and a "plunge" axis orthogonal to the bore of the barrel.

Figure 67:
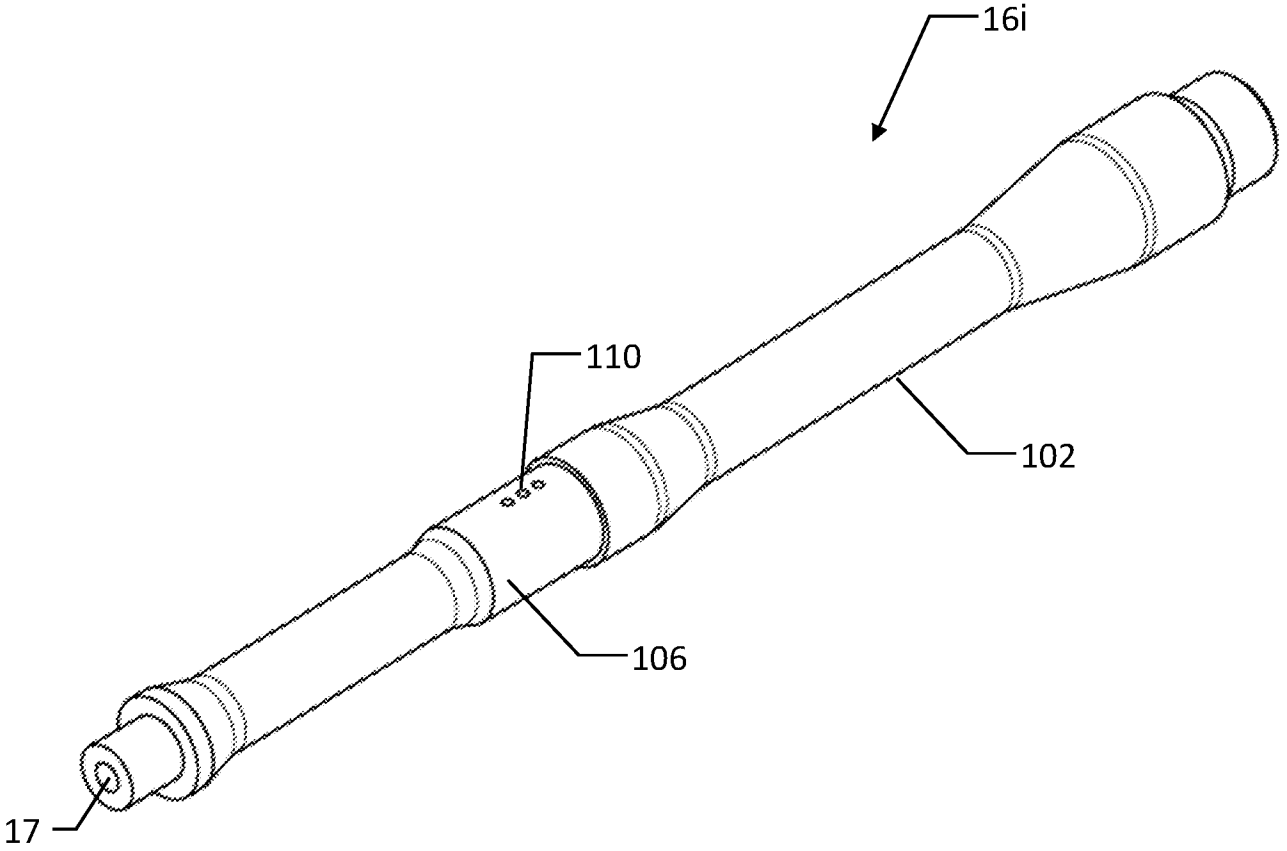
FIG. 67 illustrates a barrel including gas ports according to another example embodiment of the present disclosure.
Figure 68:
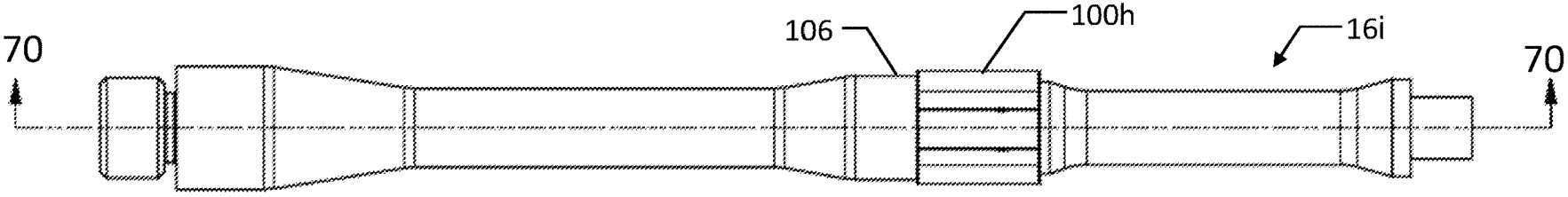
FIG. 68 is a top view of the barrel of FIG. 67 including a gas block.
Figure 69:
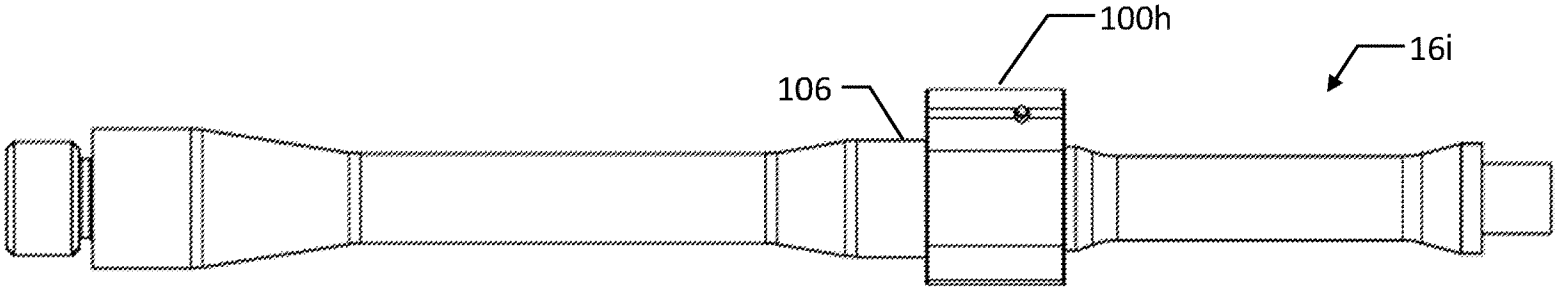
FIG. 69 is a profile view of the barrel of FIG. 67 including the gas block.
Figure 70:
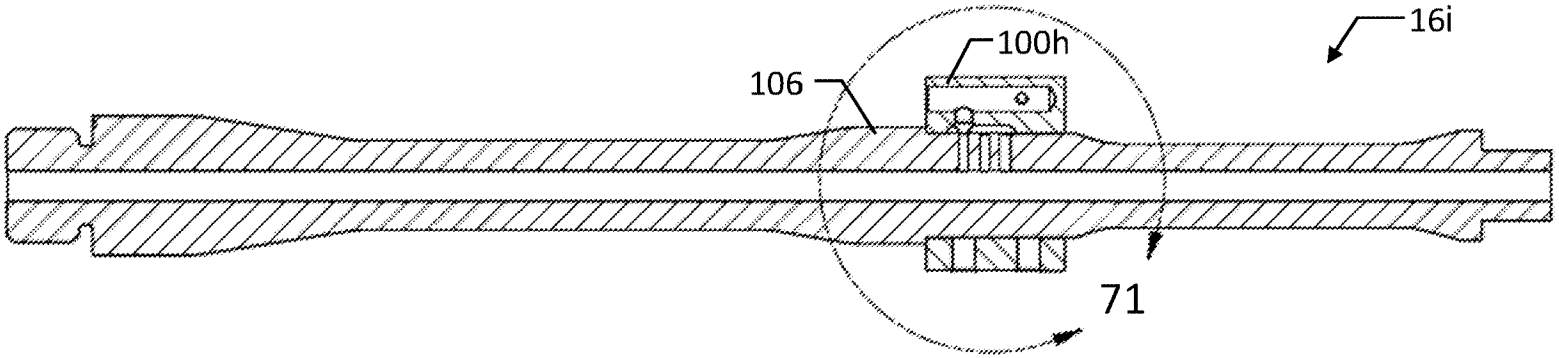
FIG. 70 is a cross-section view of the barrel of FIG. 68 taken along section line "70-70".
Figure 71:
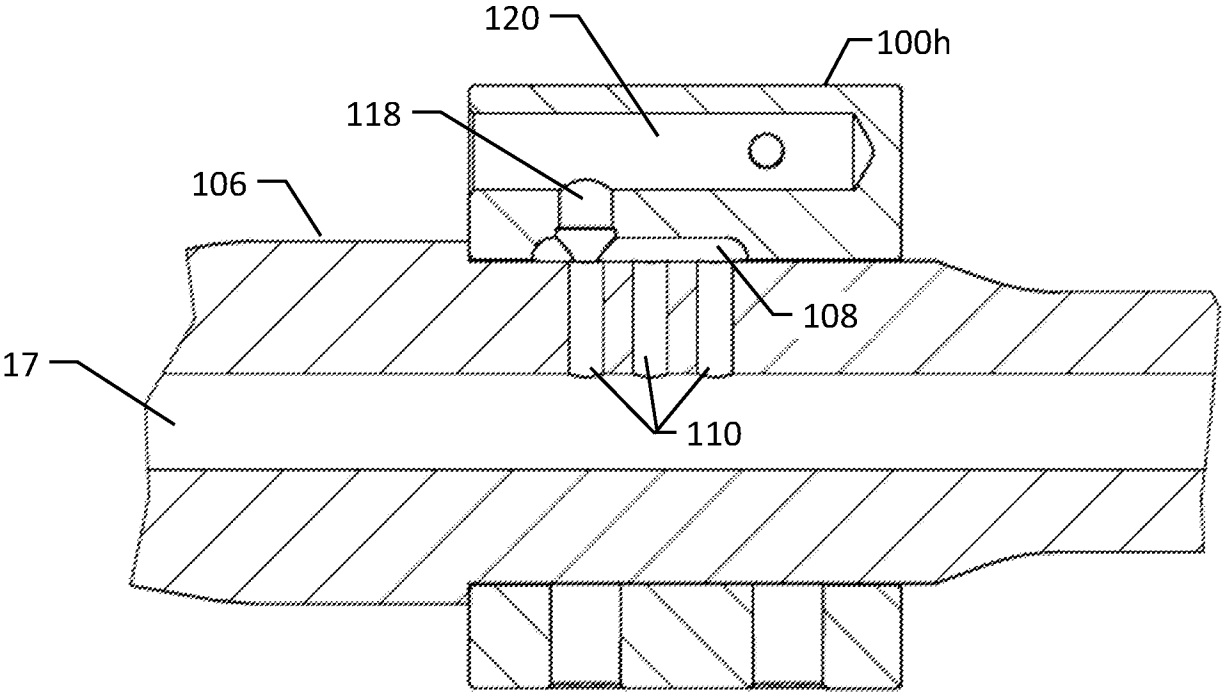
FIG. 71 is a detail view of the cross-section of FIG. 70 shown in detail circle "71".

FIG. 67 illustrates another example embodiment of linearly and axially displaced gas ports. As shown with barrel **16*i*, there are three gas ports 110 formed in the barrel 16*i* through surface portion 106 into the bore 17. FIG. 68 illustrates a top view of the barrel 16*i* including the gas block 100*h*, while FIG. 69 illustrates a profile view of the barrel 16*i* including the gas block 100*h*. FIG. 70 illustrates a profile view of the barrel 16*i* taken along section line 70-70 of FIG. 68. FIG. 71 illustrates the detail section view of circle 71 of FIG. 70. As shown in FIG. 71, the three gas ports 110 are formed through the wall of the barrel extending between bore 17 and a groove 108. However, distinct from the embodiment of FIGS. 62-66, the groove 108 is not formed in the outer surface portion 106 of the barrel 16*i*, but instead the groove 108 is formed within the gas block 100*h*. The groove 108 of the gas block 100*h* is in fluid communication with gas tube receiving passage 120 via gas block gas port 118. The groove 108 of the embodiment of FIG. 71 functions as a manifold as does the groove 108 in the embodiment of FIG. 66; however, the embodiment of FIG. 71 further simplifies manufacturing of the barrel by requiring only a drilling operation to form the gas ports 110 in the barrel 16*i***.

Figure 72:
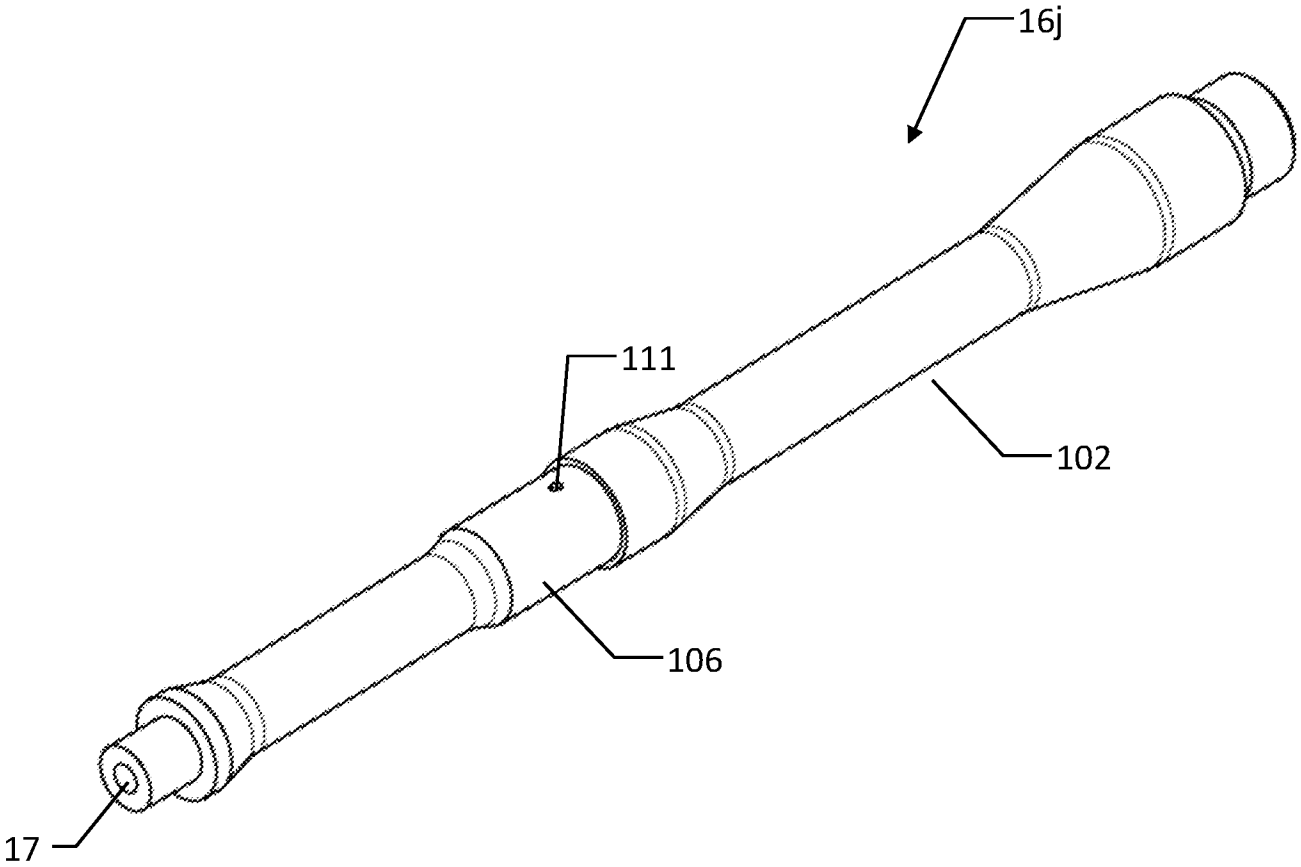
FIG. 72 illustrates a barrel including gas ports according to another example embodiment of the present disclosure.
Figure 73:
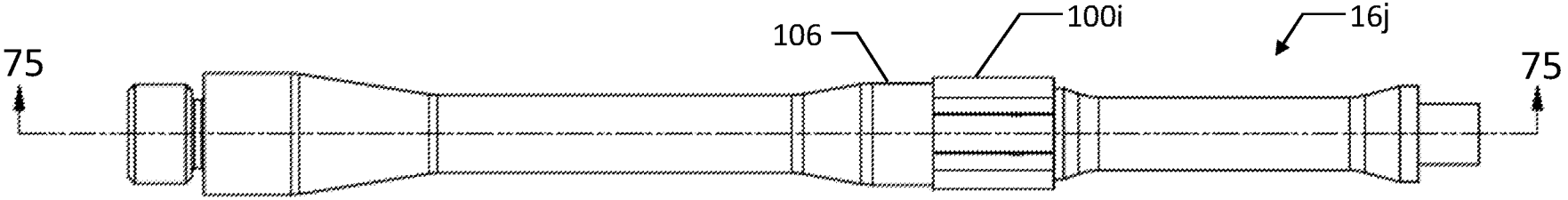
FIG. 73 is a top view of the barrel of FIG. 72 including a gas block.
Figure 74:
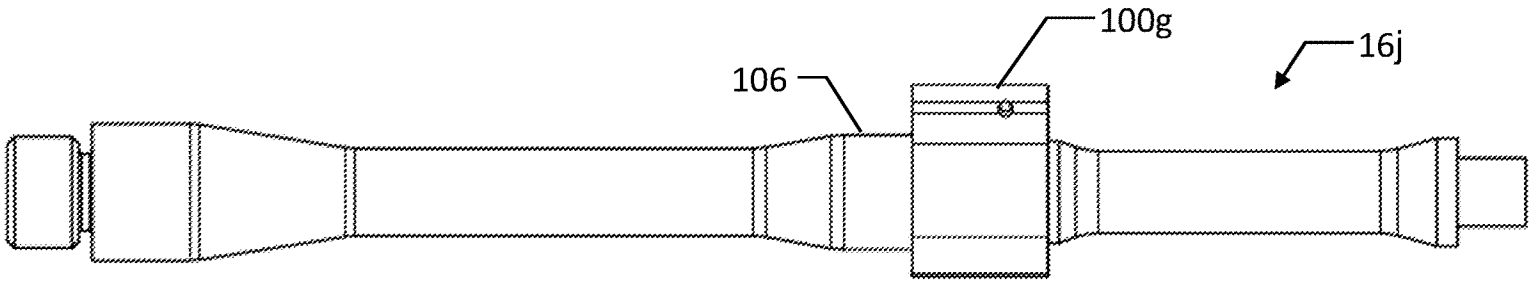
FIG. 74 is a profile view of the barrel of FIG. 72 including the gas block.
Figure 75:
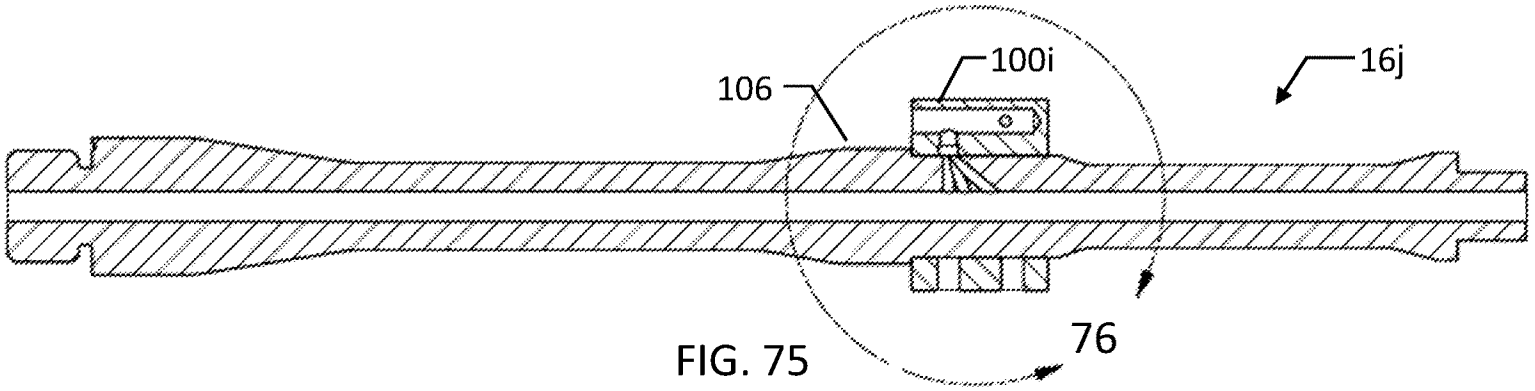
FIG. 75 is a cross-section view of the barrel of FIG. 73 taken along section line "75-75".
Figure 76:
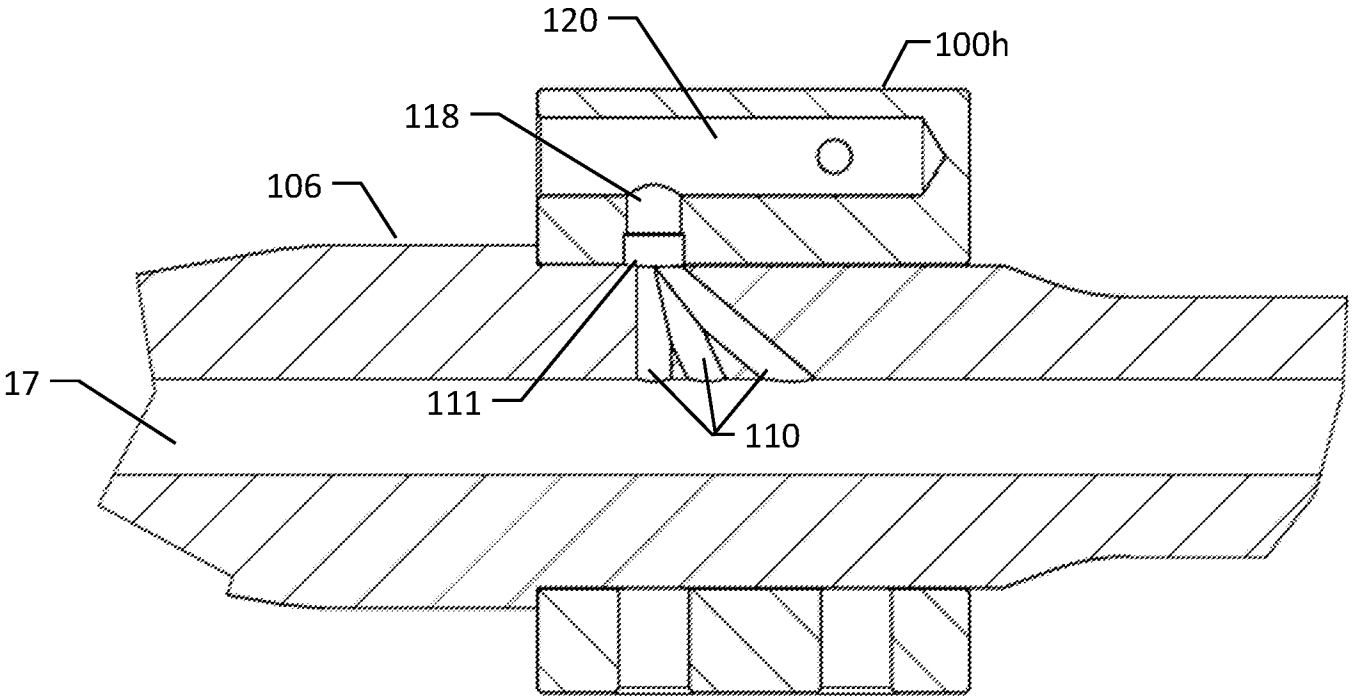
FIG. 76 is a detail view of the cross-section of FIG. 75 shown in detail circle "76".

FIG. 72 illustrates another example embodiment of a barrel **16*j* having multiple gas ports; spaced along the axis of the bore 17; however, only a single gas port exit 111 is visible in the view shown. FIG. 73 illustrates a top-view of the barrel 16*j* of FIG. 72 shown with the gas block 100*i*, while FIG. 74 illustrates a profile view of the barrel 16*j* with the gas block 100*i*. FIG. 75 illustrates a cross-section view taken along section line 75-75 of FIG. 73. FIG. 76 depicts the cross-section detail view of detail circle 76 of FIG. 75. As shown, while there are three openings of the gas ports 110 spaced along the axis of the bore 17, the three gas ports join at a single gas port exit 111. In this manner, the gas port exit 111 may form a manifold similar to the groove 68 of the preceding embodiments, but being formed by the three drill holes of the three gas ports 110 without requiring a separate milling action. The gas port exit 111 may be of a larger opening area than the opening area of the gas ports 110 within the bore 17 so as not to unnecessarily restrict the flow of gas from the three gas ports 110 through the gas port exit 111. The gas port exit 111 is in fluid communication with the gas tube receiving passage 120 via gas block gas port 118**.

Additional statements of invention are set out below:

Statement 1. An assembly for directing gas to an action of a firearm, comprising:

a barrel defining a bore configured to guide a projectile as the projectile is propelled through the bore by pressurized gas, the barrel having a plurality of barrel gas ports formed therein, each of the plurality of barrel gas ports being in fluid communication with the bore; and at least one gas block configured to align with an axial location of the plurality of barrel gas ports, the at least one gas block having a gas block gas port formed therein, wherein at least one of the barrel and the at least one gas block define a passage configured to direct the pressurized gas from the plurality of barrel gas ports to the gas block gas port.

Statement 2. The assembly of statement 1, wherein the passage is in fluid communication with the plurality of barrel gas ports and the gas block gas port.

Statement 3. The assembly of statement 1 or 2, wherein at least one of an outer surface of the barrel and an inner surface of the at least one gas block has a groove formed therein; the groove is in fluid communication with the plurality of barrel gas ports; and the groove at least partly defines the passage.

Statement 4. The assembly of statement 3, wherein the groove extends along an entire circumference of the outer surface of the barrel or an entire circumference of the inner surface of the at least one gas block.

Statement 5. The assembly of statement 4, wherein the barrel and the at least one gas block are rotationally agnostic relative to each other, such that the barrel and the at least one gas block are configured direct the pressurized gas from the plurality of barrel gas ports to the gas block gas port in at least two relative rotational positions between the barrel and the at least one gas block.

Statement 6. The assembly of statement 4, wherein the groove extends along an entire circumference of the outer surface of the barrel, wherein an exit of one of the plurality of gas ports is disposed in the groove at a first location along a length of the barrel, and wherein an exit of a second one of the plurality of barrel gas ports is positioned in the groove at a second location along the length of the barrel different than the first location.

Statement 7. The assembly of statement 3, wherein the groove extends along not more than a portion of a circumference of the outer surface of the barrel or a portion of a circumference of the inner surface of the at least one gas block.

Statement 8. The assembly of any preceding statement, wherein the barrel has an inner surface that defines the bore; each of the plurality of barrel gas ports has an entrance defined by the inner surface of the barrel; and the entrances of the plurality of barrel gas ports are spaced apart along a circumference of the inner surface barrel by substantially equal angular distances.

Statement 9. The assembly of statement 3, wherein the barrel has an inner surface that defines the bore; each of the plurality of barrel gas ports has an entrance defined by the inner surface of the barrel; the entrance of one of the plurality of barrel gas ports is positioned at a first location along a length of the barrel; and the entrance of a second one of the plurality of barrel gas ports is positioned at a second location along the length of the barrel different than the first location.

Statement 10. The assembly of statement 9, wherein the groove extends in a curvilinear path along the outer surface of the barrel or along the inner surface of the at least one gas block.

Statement 11. The assembly of statement 9, wherein the groove extends in a linear path along the outer surface of the barrel or along the inner surface of the at least one gas block.

Statement 12. The assembly of any preceding statement, wherein the plurality of barrel gas ports comprises three barrel gas ports.

Statement 13. The assembly of any preceding statement, wherein the at least one gas block has a gas tube receiving passage formed therein and configured to receive an end of a gas tube, wherein the gas tube receiving passage is in fluid communication with the gas block gas port.

Statement 14. The assembly of statement 3, wherein the groove is formed in the outer surface of the barrel; and the passage is defined by the groove and an adjacent portion of the inner surface of the at least one gas block.

Statement 15. The assembly of statement 3, wherein an exit of each of the plurality of barrel gas ports is located at least partly within the groove.

Statement 16. The assembly of statement 3, wherein the groove is formed in the inner surface of the at least one gas block; and the passage is defined by the groove and an adjacent portion of the outer surface of the barrel.

Statement 17. The assembly of any preceding statement, wherein the plurality of barrel gas ports extend radially in relation to a longitudinal axis of the barrel.

Statement 18. The assembly of statement 3, wherein the groove has a semi-circular cross section.

Statement 19. The assembly of any preceding statement, wherein the passage and the plurality of barrel gas ports form a manifold operable to supply a stream of the pressurized gas to the gas block gas port from the plurality of barrel gas ports.

Statement 20. The assembly of any preceding statement, wherein the at least one gas block is configured to be mounted on the barrel.

Statement 21. The assembly of any preceding statement, wherein the at least one gas block and the barrel define a single integral piece.

Statement 22. A firearm, comprising the assembly of any preceding statement.

Statement 23. An assembly for directing gas to an action of a firearm, comprising:

a barrel defining a bore configured to guide a projectile as the projectile is propelled through the bore by pressurized gas, the barrel having a plurality of gas ports formed therein, each of the gas ports being in fluid communication with the bore; and at least one gas block configured to align with an axial location of the plurality of barrel gas ports, wherein: the at least one gas block has a gas port formed therein; the at least one gas block comprises a conduit having an entrance and an exit; and the conduit is configured so that the entrance to the conduit aligns with, and is in fluid communication with one of the plurality of barrel gas ports, and the exit aligns with, and is in fluid communication with the gas block gas port.

Statement 24. The assembly of statement 23, wherein the at least one gas block is configured so that the gas block gas port aligns with and is in fluid communication with another one of the plurality of barrel gas ports.

Statement 25. A firearm comprising the assembly of statement 23 or 24.

Statement 26. A barrel for a firearm comprising:

an inner surface defining a bore configured to guide a projectile as the projectile is propelled through the bore by pressurized gas, wherein the barrel has a plurality of barrel gas ports formed therein, wherein each of the plurality of barrel gas ports has an entrance defined by the inner surface of the barrel, and wherein each of the plurality of barrel gas ports is configured to simultaneously fluidically connect to an action of the firearm.

Statement 27. The barrel of statement 26, wherein an outer surface of the barrel has a groove formed therein, wherein the groove is in fluid communication with the plurality of barrel gas ports, and wherein the groove at least partly defines a passage for directing the pressurized gas to the action of the firearm.

Statement 28. The barrel of statement 26 or 27, wherein at least two of the plurality of barrel gas ports are disposed at different axial locations along a length of the barrel.

Statement 29. The barrel of any of statements 26 to 28, wherein the plurality of barrel gas ports are spaced circumferentially about the barrel.

Statement 30. The barrel of any of statements 26 to 29, wherein each of the plurality of barrel gas ports is defined at a same axial location along a length of the barrel.

Statement 31. A firearm comprising the barrel of any of statements 26 to 30.

Statement 32. An assembly for directing gas to an action of a firearm, comprising:

a barrel having an interior surface, the interior surface defining a plurality of entrance openings configured to receive pressurized gas therethrough;

means for directing the pressurized gas from each of the plurality of entrance openings to the action of the firearm.

Statement 33. The assembly of statement 32, wherein at least two of the plurality of barrel gas ports are disposed at different axial locations along a length of the barrel.

Statement 34. The assembly of statement 32 or 33, wherein the plurality of entrance openings are spaced circumferentially about the barrel.

Statement 35. The assembly of statement 32, wherein each of the plurality of entrance openings is defined at a same axial location along a length of the barrel.

Statement 36. The assembly of any of statement 32 to 35, wherein the means for directing the pressurized gas from each of the plurality of entrance openings to the action of the firearm comprises a means for combining portions of the pressurized gas associated with each of the plurality of entrance openings into a single flow upstream of the action.

Statement 37. A firearm comprising the assembly of any of statements 32 to 36.

Statement 38. An assembly for directing gas to an action of a firearm, comprising:

a barrel defining a bore configured to guide a projectile as the projectile is propelled through the bore by pressurized gas, the barrel having a plurality of barrel gas ports formed therein, each of the plurality of barrel gas ports being in fluid communication with the bore; and at least one gas block configured to align with an axial location of the plurality of barrel gas ports, the at least one gas block having a gas block gas port formed therein, wherein at least one of the barrel and the at least one gas block define a passage configured to direct the pressurized gas from the plurality of barrel gas ports to the gas block gas port.

Statement 39. The assembly of statement 38, wherein the passage is in fluid communication with the plurality of barrel gas ports and the gas block gas port.

Statement 40. The assembly of statement 38, wherein at least one of an outer surface of the barrel and an inner surface of the at least one gas block has a groove formed therein, the groove is in fluid communication with the plurality of barrel gas ports, and the groove at least partly defines the passage.

Statement 41. The assembly of statement 40, wherein the plurality of barrel gas ports are spaced apart along a line parallel to an axis along which the barrel extends.

Statement 42. The assembly of statement 41, wherein the groove covers the plurality of barrel gas ports.

Statement 43. The assembly of statement 40, wherein the groove is formed in the outer surface of the barrel, and the passage is defined by the groove and an adjacent portion of the inner surface of the at least one gas block.

Statement 44. The assembly of statement 38, wherein the plurality of barrel gas ports are spaced apart along a line parallel to an axis along which the barrel extends.

Statement 45. The assembly of statement 38, wherein the plurality of barrel gas ports are parallel to one another, and axes of each of the barrel gas ports are offset relative to one another.

Statement 46. The assembly of statement 38, wherein a groove is defined in the bore, wherein each of the plurality of barrel gas ports extend from the groove to the bore of the barrel.

Statement 47. The assembly of statement 38, wherein the plurality of barrel gas ports extend from a common opening at a surface of the barrel to individual openings within the bore of the barrel.

Statement 48. The assembly of statement 47, wherein the individual openings are displaced from one another linearly along an axis defined by the bore.

Statement 49. The assembly of claim 38, wherein the barrel has an inner surface that defines the bore, wherein each of the plurality of barrel gas ports has an entrance defined by the inner surface of the barrel, wherein the entrance of one of the plurality of barrel gas ports is positioned at a first location along a length of the barrel, and wherein the entrance of a second one of the plurality of barrel gas ports is positioned at a second location along the length of the barrel different than the first location.

Statement 50. The assembly of statement 38, wherein the at least one gas block has a gas tube receiving passage formed therein and configured to receive an end of a gas tube, wherein the gas tube receiving passage is in fluid communication with the gas block gas port.

Statement 51. The assembly of statement 38, wherein the passage and the plurality of barrel gas ports form a manifold operable to supply a stream of the pressurized gas to the gas block gas port from the plurality of barrel gas ports.

Statement 52. The assembly of statement 38, wherein the at least one gas block is configured to be mounted on the barrel.

Statement 53. The assembly of statement 38, wherein the at least one gas block and the barrel define a single integral piece.

Statement 54. A firearm, comprising the assembly of statement 1.

Statement 55. An assembly for directing gas to an action of a firearm, comprising:

a barrel defining a bore configured to guide a projectile as the projectile is propelled through the bore by pressurized gas, the barrel having a plurality of barrel gas ports formed therein, each of the barrel gas ports being in fluid communication with the bore; and at least one gas block configured to align with an axial location of the plurality of barrel gas ports, wherein: the at least one gas block has a gas port formed therein; the at least one gas block comprises a conduit having an entrance and an exit; and the conduit is configured so that the entrance to the conduit aligns with, and is in fluid communication with one of the plurality of barrel gas ports, and the exit aligns with, and is in fluid communication with the gas block gas port.

Statement 56. The assembly of statement 55, wherein the at least one gas block is configured so that the gas block gas port aligns with and is in fluid communication with another one of the plurality of barrel gas ports.

Statement 57. The assembly of statement 55, wherein the gas block gas port aligns with the plurality of barrel gas ports, and wherein the plurality of barrel gas ports are displaced relative to one another along an axis along which the barrel extends.

Statement 58. A firearm comprising the assembly of statement 55.

Statement 59. A barrel for a firearm comprising:

an inner surface defining a bore configured to guide a projectile as the projectile is propelled through the bore by pressurized gas, wherein the barrel has a plurality of barrel gas ports formed therein, wherein each of the plurality of barrel gas ports has an entrance defined by the inner surface of the barrel, and wherein each of the plurality of barrel gas ports is configured to simultaneously fluidically connect to an action of the firearm.

Statement 60. The barrel of statement 59, wherein the plurality of barrel gas ports are displaced relative to one another along an axis along which the barrel extends.

Statement 61. The barrel of statement 60, wherein the plurality of barrel gas ports are disposed along a line extending along the axis along which the barrel extends.

Statement 62. The barrel of statement 59, wherein an outer surface of the barrel has a groove formed therein, wherein the groove is in fluid communication with the plurality of barrel gas ports, and wherein the groove at least partly defines a passage for directing the pressurized gas to the action of the firearm.

Statement 63. The barrel of statement 60, wherein at least two of the plurality of barrel gas ports are disposed at different axial locations along a length of the barrel.

Statement 64. The barrel of statement 63, wherein the plurality of barrel gas ports are spaced radially about the barrel.

Statement 65. The barrel of statement 59, wherein each of the plurality of barrel gas ports is defined at a same axial location along a length of the barrel.

Statement 66. A firearm comprising the barrel of statement 59.

Statement 67. An assembly for directing gas to an action of a firearm, comprising:

a barrel having an interior surface, the interior surface defining a plurality of entrance openings configured to receive pressurized gas therethrough;

means for directing the pressurized gas from each of the plurality of entrance openings to the action of the firearm.

Statement 68. The assembly of statement 67, wherein the plurality entrance openings configured to receive pressurized gas therethrough are displaced relative to one another along an axis along which the barrel extends.

Statement 69. The assembly of statement 68, wherein the plurality entrance openings configured to receive pressurized gas therethrough are disposed along a line parallel to the axis along which the barrel extends.

Statement 70. The assembly of statement 67, wherein at least two of the plurality of barrel gas ports are disposed at different axial locations along a length of the barrel.

Statement 71. The assembly of statement 70, wherein the plurality of entrance openings are spaced radially about the barrel.

Statement 72. The assembly of statement 67, wherein each of the plurality of entrance openings is defined at a same axial location along a length of the barrel.

Statement 73. The assembly of statement 67, wherein the means for directing the pressurized gas from each of the plurality of entrance openings to the action of the firearm comprises a means for combining portions of the pressurized gas associated with each of the plurality of entrance openings into a single flow upstream of the action.

Statement 74. A firearm comprising the assembly of statement 67.

The various embodiments described above are provided by way of illustration only and should not be construed to limit the claims attached hereto. Those skilled in the art will readily recognize various modifications and changes that may be made without following the example embodiments and applications illustrated and described herein, and without departing from the scope of the following claims.

I claim:

1. An assembly for directing gas to an action of a firearm, comprising:

a barrel defining a bore configured to guide a projectile as the projectile is propelled through the bore by pressurized gas, the barrel having a plurality of barrel gas ports formed therein, each of the plurality of barrel gas ports being in fluid communication with the bore; and at least one gas block configured to align with an axial location of the plurality of barrel gas ports, the at least one gas block having a gas block gas port formed therein, wherein the at least one gas block defines a groove as part of a passage configured to direct the pressurized gas from the plurality of barrel gas ports to the gas block gas port, wherein the groove extends around an entire circumference of an inner surface of the at least one gas block wherein all of the plurality of barrel gas ports are in fluid communication with the groove, wherein the gas block gas port is in fluid communication with the groove, and the assembly is configured to conduct pressurized gas from the barrel through the plurality of barrel gas ports into the groove and from the groove into the gas block gas port, wherein the plurality of barrel gas ports are spaced apart radially about an axis of the barrel.

2. The assembly of claim 1, wherein the groove covers the plurality of barrel gas ports.

3. The assembly of claim 1, wherein the passage is defined by the groove and an adjacent portion of an outer surface of the barrel.

4. The assembly of claim 1, wherein the passage and the plurality of barrel gas ports form a manifold operable to supply a stream of the pressurized gas to the gas block gas port from the plurality of barrel gas ports.

5. A firearm, comprising the assembly of claim 1.

6. The assembly of claim 1, wherein the plurality of barrel gas ports are angularly offset in relation to a radial direction from an axial centerline of the barrel.

7. A barrel for a firearm comprising:

an inner surface defining a bore configured to guide a projectile as the projectile is propelled through the bore by pressurized gas, wherein the barrel has a plurality of barrel gas ports formed therein, wherein each of the plurality of barrel gas ports has an entrance defined by the inner surface of the barrel, wherein each of the plurality of barrel gas ports is configured to simultaneously fluidically connect to an action of the firearm, and wherein the plurality of barrel gas ports are spaced radially about an axis defined through the bore, wherein angular spacing of adjacent barrel gas ports is irregular.

8. The barrel of claim 7, wherein the plurality of barrel gas ports are displaced relative to one another along an axis along which the barrel extends.

9. The barrel of claim 7, wherein an outer surface of the barrel has a groove formed therein, wherein the groove is in fluid communication with the plurality of barrel gas ports, and wherein the groove at least partly defines a passage for directing the pressurized gas to the action of the firearm.

10. A firearm comprising the barrel of claim 7.

11. An assembly for directing gas to an action of a firearm, comprising:

a barrel defining a bore configured to guide a projectile as the projectile is propelled through the bore by pressurized gas, the barrel having a plurality of barrel gas ports formed therein, each of the plurality of barrel gas ports being in fluid communication with the bore; and at least one gas block configured to align with an axial location of the plurality of barrel gas ports, wherein: the at least one gas block has a gas block gas port formed therein; the at least one gas block comprises a conduit having an entrance and an exit, and the conduit is configured so that the entrance to the conduit aligns with, and is in fluid communication with one of the plurality of barrel gas ports, and the exit aligns with, and is in fluid communication with the gas block gas port, wherein at least one of the barrel and the at least one gas block define a groove as part of a passage configured to direct the pressurized gas from the plurality of barrel gas ports to the gas block gas port, wherein the groove does not encircle a circumference of the barrel, wherein all of the plurality of barrel gas ports are in direct fluid communication with the groove, and wherein the gas block gas port is in direct fluid communication with the groove, and wherein pressurized gas from the barrel is conducted through the plurality of barrel gas ports, through the groove, and into the gas block gas port, wherein the gas block gas port aligns with the plurality of barrel gas ports, and wherein the plurality of barrel gas ports are radially displaced relative to one another about an axis along which the bore extends.

12. The assembly of claim 11, wherein the groove covers the plurality of barrel gas ports.

13. The assembly of claim 11, wherein the groove is formed in an outer surface of the barrel, and the passage is defined by the groove and an adjacent portion of an inner surface of the at least one gas block.

14. The assembly of claim 11, wherein the plurality of barrel gas ports are spaced apart longitudinally along an axis of the barrel.

15. The assembly of claim 11, wherein the passage and the plurality of barrel gas ports form a manifold operable to supply a stream of the pressurized gas to the gas block gas port from the plurality of barrel gas ports.

16. A firearm, comprising the assembly of claim 11.

17. The assembly of claim 11, wherein the at least one gas block defines the groove, wherein the groove extends around only a portion of a circumference of the inner surface of the at least one gas block.

18. The assembly of claim 11, wherein the plurality of barrel gas ports are angularly offset in relation to a radial direction from an axial centerline of the barrel.

* * * * *